US008919013B2

(12) United States Patent
Christensen et al.

(10) Patent No.: US 8,919,013 B2
(45) **Date of Patent: *Dec. 30, 2014**

(54) ARTICLE OF FOOTWEAR HAVING AN ADJUSTABLE RIDE

(75) Inventors: Brian Christensen, Centerville, MA (US); Paul Davis, Blackstone, MA (US); William Marvin, Canton, MA (US)

(73) Assignee: Reebok International Limited, London (GB)

( * ) Notice: Subject to any disclaimer, the term of this patent is extended or adjusted under 35 U.S.C. 154(b) by 195 days.

This patent is subject to a terminal disclaimer.

(21) Appl. No.: 13/457,227

(22) Filed: Apr. 26, 2012

(65) Prior Publication Data

US 2012/0210601 A1 Aug. 23, 2012

Related U.S. Application Data

(63) Continuation of application No. 12/419,760, filed on Apr. 7, 2009, now Pat. No. 8,256,141, which is a continuation-in-part of application No. 11/610,382, filed on Dec. 13, 2006, now Pat. No. 7,694,438.

(51) Int. Cl.

| | |
|---|---|
| ***A43B 3/20*** | (2006.01) |
| ***A43B 13/12*** | (2006.01) |
| ***A43B 7/16*** | (2006.01) |
| ***A43B 3/24*** | (2006.01) |
| ***A43B 13/20*** | (2006.01) |

(52) U.S. Cl.

CPC . *A43B 13/12* (2013.01); *A43B 7/16* (2013.01); *A43B 3/24* (2013.01); *A43B 3/246* (2013.01); *A43B 13/203* (2013.01)

USPC ..... 36/29; 36/35 B; 36/81

(58) Field of Classification Search

CPC ..... A43B 13/203; A43B 13/12; A43B 3/246; A43B 7/16; A43B 7/38

USPC ..... 36/29, 35 B, 81, 28, 93, 88

See application file for complete search history.

(56) References Cited

U.S. PATENT DOCUMENTS

| | | | |
|---|---|---|---|
| 508,034 | A | 11/1893 | Moore |
| 547,645 | A | 10/1895 | MacDonald |
| 566,422 | A | 8/1896 | Singleton |
| 580,501 | A | 4/1897 | Mobberley |

(Continued)

FOREIGN PATENT DOCUMENTS

| | | |
|---|---|---|
| BR | 8305004 | 4/1985 |
| DE | 3427644 | 1/1986 |

(Continued)

*Primary Examiner* — Ted Kavanaugh

(74) *Attorney, Agent, or Firm* — Sterne, Kessler, Goldstein & Fox P.L.L.C.

(57) ABSTRACT

An article of footwear has an upper and a sole. The sole has an upper sole member, a lower sole member, and at least one inflatable bladder disposed between the upper sole member and the lower sole member. The at least one inflatable bladder has an inflated state and a deflated state. A distance between the upper sole member and the lower sole member is greater in the inflated state than the deflated state. Varying the inflation of the inflatable bladder varies the amount of cushioning in the sole and the thickness of the sole so that the shoe can serve as a multipurpose shoe for activities requiring different amounts of cushioning.

17 Claims, 21 Drawing Sheets

(56) References Cited

U.S. PATENT DOCUMENTS

| | | | | |
|---|---|---|---|---|
| 586,155 | A | | 7/1897 | Bascom |
| 850,327 | A | | 4/1907 | Tauber |
| 1,069,001 | A | | 7/1913 | Guy |
| 1,148,376 | A | | 7/1915 | Gay |
| 1,193,608 | A | | 8/1916 | Poulson |
| 1,198,476 | A | | 9/1916 | Pearson |
| 1,304,915 | A | | 5/1919 | Spinney |
| 1,328,154 | A | | 1/1920 | Jackerson |
| 1,498,838 | A | | 6/1924 | Harrison, Jr. |
| 1,605,985 | A | | 11/1926 | Rasmussen |
| 1,942,883 | A | | 1/1934 | Adolf |
| 1,954,122 | A | | 4/1934 | Fiori |
| 1,979,972 | A | | 11/1934 | Guild |
| 2,007,803 | A | | 7/1935 | Kelly |
| 2,020,240 | A | | 11/1935 | Cochran |
| 2,036,695 | A | | 4/1936 | Heigis |
| 2,080,469 | A | | 5/1937 | Gilbert |
| 2,080,499 | A | | 5/1937 | Nathansohn |
| 2,177,116 | A | | 10/1939 | Persichino |
| 2,488,382 | A | | 11/1949 | Davis |
| 2,532,742 | A | | 12/1950 | Stoiner |
| 2,600,239 | A | | 6/1952 | Gilbert |
| 2,605,560 | A | | 8/1952 | Gouabault |
| 2,638,690 | A | | 5/1953 | Bullard, III |
| 2,677,904 | A | | 5/1954 | Reed |
| 2,682,712 | A | | 7/1954 | Owsen et al. |
| 2,717,100 | A | | 9/1955 | Engelder |
| 2,756,517 | A | * | 7/1956 | Youtz ..... 36/7.8 |
| 2,774,152 | A | | 12/1956 | Alber |
| 2,863,230 | A | | 12/1958 | Cortina |
| 2,981,010 | A | | 4/1961 | Aaskov |
| 3,015,414 | A | | 1/1962 | Wilson |
| 3,027,659 | A | | 4/1962 | Gianola |
| 3,044,190 | A | | 7/1962 | Urbany |
| 3,068,494 | A | | 12/1962 | Pinkwater |
| 3,120,712 | A | | 2/1964 | Menken |
| 3,221,932 | A | | 12/1965 | Anderson |
| 3,225,463 | A | | 12/1965 | Burnham |
| 3,331,146 | A | | 7/1967 | Karras |
| 3,372,495 | A | | 3/1968 | Finn |
| 3,410,004 | A | | 11/1968 | Finn |
| 3,664,043 | A | | 5/1972 | Polumbus, Jr. |
| 3,685,176 | A | | 8/1972 | Rudy |
| 3,716,930 | A | | 2/1973 | Brahm |
| 3,744,159 | A | | 7/1973 | Nishimura |
| 3,751,833 | A | * | 8/1973 | Humphrey ..... 36/81 |
| 3,760,056 | A | | 9/1973 | Rudy |
| 3,854,228 | A | | 12/1974 | Conroy |
| 3,973,336 | A | | 8/1976 | Ahn |
| 3,995,653 | A | | 12/1976 | Mackal et al. |
| 4,014,048 | A | | 3/1977 | Rappleyea |
| 4,106,222 | A | | 8/1978 | Houck |
| 4,129,951 | A | | 12/1978 | Petrosky |
| 4,169,353 | A | | 10/1979 | Fresard |
| 4,217,705 | A | | 8/1980 | Donzis |
| 4,219,945 | A | | 9/1980 | Rudy |
| 4,232,459 | A | | 11/1980 | Vaccari |
| 4,271,606 | A | | 6/1981 | Rudy |
| 4,361,969 | A | | 12/1982 | Vermonet |
| 4,397,104 | A | | 8/1983 | Doak |
| 4,417,407 | A | | 11/1983 | Fukuoka |
| 4,446,634 | A | | 5/1984 | Johnson et al. |
| 4,458,430 | A | | 7/1984 | Peterson |
| 4,462,171 | A | | 7/1984 | Whispell |
| 4,525,941 | A | | 7/1985 | Ruth |
| 4,571,853 | A | | 2/1986 | Medrano |
| 4,610,099 | A | | 9/1986 | Signori |
| 4,628,945 | A | | 12/1986 | Johnson, Jr. |
| 4,662,087 | A | | 5/1987 | Beuch |
| 4,662,412 | A | | 5/1987 | Swallert |
| 4,670,995 | A | | 6/1987 | Huang |
| 4,676,009 | A | * | 6/1987 | Davis et al. ..... 36/7.8 |
| 4,700,403 | A | | 10/1987 | Vacanti |
| 4,702,022 | A | | 10/1987 | Porcher |
| 4,730,403 | A | | 3/1988 | Walkhoff |
| 4,744,157 | A | | 5/1988 | Dubner |
| 4,760,651 | A | | 8/1988 | Pon-Tzu |
| 4,763,426 | A | | 8/1988 | Polus et al. |
| 4,776,110 | A | | 10/1988 | Shlang |
| 4,805,601 | A | | 2/1989 | Eischen, Sr. |
| 4,823,482 | A | | 4/1989 | Lakic |
| 4,856,208 | A | | 8/1989 | Zaccaro |
| 4,887,367 | A | | 12/1989 | Mackness et al. |
| 4,906,502 | A | | 3/1990 | Rudy |
| 4,910,889 | A | | 3/1990 | Bonaventure et al. |
| 4,912,861 | A | | 4/1990 | Huang |
| D314,172 | S | | 1/1991 | Whitley, II |
| 4,991,317 | A | | 2/1991 | Lakic |
| 4,995,173 | A | | 2/1991 | Spier |
| 5,025,575 | A | | 6/1991 | Lakic |
| 5,074,765 | A | | 12/1991 | Pekar |
| 5,083,320 | A | | 1/1992 | Halstead |
| 5,113,599 | A | | 5/1992 | Cohen et al. |
| 5,129,107 | A | | 7/1992 | Lorenzo |
| 5,144,708 | A | | 9/1992 | Pekar |
| 5,155,864 | A | | 10/1992 | Walker et al. |
| 5,155,865 | A | | 10/1992 | Walker et al. |
| 5,155,866 | A | | 10/1992 | Walker et al. |
| 5,158,767 | A | | 10/1992 | Cohen et al. |
| 5,181,279 | A | | 1/1993 | Ross |
| 5,195,254 | A | | 3/1993 | Tyng |
| 5,199,191 | A | | 4/1993 | Moumdjian |
| 5,230,249 | A | | 7/1993 | Sasaki et al. |
| 5,253,435 | A | | 10/1993 | Auger et al. |
| 5,257,470 | A | | 11/1993 | Auger et al. |
| 5,279,051 | A | | 1/1994 | Whatley |
| 5,343,638 | A | | 9/1994 | Legassie et al. |
| 5,351,710 | A | | 10/1994 | Phillips |
| 5,353,525 | A | | 10/1994 | Grim |
| 5,392,534 | A | | 2/1995 | Grim |
| 5,406,661 | A | | 4/1995 | Pekar |
| 5,416,988 | A | | 5/1995 | Potter et al. |
| 5,444,926 | A | | 8/1995 | Allen et al. |
| 5,638,565 | A | | 6/1997 | Pekar |
| 5,692,321 | A | | 12/1997 | Holstine |
| 5,740,619 | A | * | 4/1998 | Broder ..... 36/61 |
| 5,765,298 | A | | 6/1998 | Potter et al. |
| 5,771,606 | A | | 6/1998 | Litchfield et al. |
| 5,806,208 | A | | 9/1998 | French |
| 5,815,951 | A | * | 10/1998 | Jordan ..... 36/61 |
| 5,893,219 | A | | 4/1999 | Smith et al. |
| 5,979,078 | A | | 11/1999 | McLaughlin |
| 5,987,779 | A | | 11/1999 | Litchfield et al. |
| 6,014,823 | A | | 1/2000 | Lakic |
| 6,134,812 | A | | 10/2000 | Voss |
| 6,161,240 | A | | 12/2000 | Huang |
| 6,195,914 | B1 | | 3/2001 | Otis |
| 6,237,251 | B1 | | 5/2001 | Litchfield et al. |
| 6,247,248 | B1 | * | 6/2001 | Clark ..... 36/3 B |
| 6,287,225 | B1 | | 9/2001 | Touhey et al. |
| 6,354,020 | B1 | | 3/2002 | Kimball et al. |
| 6,430,843 | B1 | | 8/2002 | Potter et al. |
| 6,505,420 | B1 | | 1/2003 | Litchfield et al. |
| 6,510,624 | B1 | | 1/2003 | Lakic |
| 6,550,160 | B2 | * | 4/2003 | Miller, II ..... 36/127 |
| 6,553,691 | B2 | | 4/2003 | Huang |
| 6,785,985 | B2 | | 9/2004 | Marvin et al. |
| 6,845,573 | B2 | * | 1/2005 | Litchfield et al. ..... 36/29 |
| 6,892,477 | B2 | | 5/2005 | Potter et al. |
| 6,988,329 | B2 | | 1/2006 | Marvin et al. |
| 6,996,922 | B2 | | 2/2006 | Ryoo |
| 7,047,670 | B2 | | 5/2006 | Marvin et al. |
| 7,051,456 | B2 | | 5/2006 | Swigart et al. |
| 7,152,343 | B2 | | 12/2006 | Whatley |
| 7,152,625 | B2 | | 12/2006 | Marvin et al. |
| 7,210,249 | B2 | | 5/2007 | Passke et al. |
| 7,600,330 | B2 | | 10/2009 | Chen |
| 7,694,438 | B1 | | 4/2010 | Christensen et al. |
| 8,256,141 | B2 | | 9/2012 | Christensen et al. |
| 2004/0211085 | A1 | | 10/2004 | Passke et al. |
| 2005/0028404 | A1 | | 2/2005 | Marvin et al. |
| 2005/0132617 | A1 | | 6/2005 | Potter et al. |
| 2006/0162186 | A1 | | 7/2006 | Marvin et al. |
| 2006/0272179 | A1 | | 12/2006 | Passke et al. |

(56) References Cited

U.S. PATENT DOCUMENTS

| | | | |
|---|---|---|---|
| 2007/0084082 | A1 | 4/2007 | Dojan et al. |
| 2007/0084083 | A1 | 4/2007 | Hazenberg et al. |
| 2008/0313928 | A1 | 12/2008 | Adams et al. |
| 2009/0235557 | A1 | 9/2009 | Christensen et al. |

FOREIGN PATENT DOCUMENTS

| | | | |
|---|---|---|---|
| EP | 40189 | | 11/1981 |
| EP | 152401 | | 8/1985 |
| EP | 184781 | A1 | 6/1986 |
| EP | 229273 | | 7/1987 |
| EP | 389215 | A1 | 9/1990 |
| EP | 472110 | A2 | 2/1992 |
| EP | 629360 | A1 | 12/1994 |
| EP | 630592 | A1 | 12/1994 |
| FR | 2496423 | | 6/1982 |
| GB | 520514 | | 12/1939 |
| GB | 2114425 | A | 8/1983 |
| GB | 2165439 | A | 4/1986 |
| GB | 2240254 | A | 7/1991 |
| GB | 2271710 | A | 4/1994 |
| TW | 95419 | | 2/1989 |
| WO | WO 87/03789 | | 7/1987 |
| WO | WO 89/10074 | | 11/1989 |
| WO | WO 90/04323 | | 5/1990 |
| WO | WO 91/18527 | | 12/1991 |
| WO | WO 93/14659 | | 8/1993 |
| WO | WO 93/21790 | | 11/1993 |

* cited by examiner

ARTICLE OF FOOTWEAR HAVING AN ADJUSTABLE RIDE

CROSS REFERENCE TO RELATED APPLICATIONS

This application is a continuation of U.S. application Ser. No. 12/419,760, filed on Apr. 7, 2009, which is a continuation-in-part of U.S. patent application Ser. No. 11/610,382, filed on Dec. 13, 2006, now U.S. Pat. No. 7,694,438, the disclosures of which are hereby incorporated in their entirety by reference thereto.

BACKGROUND OF THE INVENTION

1. Field of the Invention

This invention relates to footwear, and more particularly to an athletic shoe having an adjustable ride.

2. Background Art

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot.

An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters; muscle, tendon, and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. However, the sole should also possess enough resiliency to prevent the sole from being "mushy" or "collapsing," thereby unduly draining the stored energy of the wearer.

In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

However, a cushioning device which is pressurized with fluid at the factory is comparatively expensive to manufacture. Further, pressurized fluid tends to escape from such a cushioning device, requiring large molecule fluids such as Freon gas to be used as the inflating fluid. A cushioning device which contains air at ambient pressure provides several benefits over similar devices containing pressurized fluid. For example, generally a cushioning device which contains air at ambient pressure will not leak and lose air, because there is no pressure gradient in the resting state.

Athletes, particularly runners, often have a pair of training shoes and a pair of racing flats. The training shoes are worn for every day training and are selected for their ample cushioning to prevent the injuries and ailments mentioned above. However, on race day, a runner typically wears a pair of racing flats, which have a comparatively thin sole in comparison to the training shoes and less cushioning to make the shoes lighter so that the wearer can run faster. Carrying around two pairs of shoes can be cumbersome and expensive. There is a need in the art to have a single shoe that can serve as both a training shoe and a racing flat. Further, for athletes that use two different shoes for running and general training (e.g., weight training), there is a need for a shoe that can better serve both activities.

BRIEF SUMMARY OF THE INVENTION

Disclosed herein is a sole for an article of footwear comprising a sole member, an outsole, and a gap member. The gap member extends from the outsole and has a flexible portion and an end connected to the sole member such that the gap member spans a gap between the sole member and the outsole. The flexible portion allows the end to remain connected to the sole member when a size of the gap is changed.

Also disclosed herein is an outsole comprising a surface and a gap member. The gap member extends from the surface and has a flexible portion and an end connectable to a portion of an article of footwear such that the gap member spans a gap between the portion of the article of footwear (e.g., a sole member) and the outsole. The flexible portion allows the end to remain connected to the portion of the article of footwear when a size of the gap is changed.

In addition, disclosed herein is an article of footwear comprising an upper and a sole. The sole comprises an outsole and a gap member. The gap member extends from the outsole and has a flexible portion and an end connected to a portion of the article of footwear such that the gap member spans a gap between the portion of the article of footwear and the outsole.

The flexible portion allows the end to remain connected to the portion of the article of footwear when a size of the gap is changed.

Further, disclosed herein is a sole for an article of footwear comprising an upper sole member, a lower sole member, an inflatable bladder positioned between the upper sole member and the lower sole member, an outsole attached to the lower sole member, and a gap member. The gap member extends from the outsole and has a flexible portion and an end connected to the upper sole member such that the gap member spans a gap between the lower sole member and the upper sole member. The flexible portion allows the end to remain connected to the upper sole member when a size of the gap is changed

BRIEF DESCRIPTION OF THE DRAWINGS/FIGURES

DETAILED DESCRIPTION OF THE INVENTION

Figure 1:
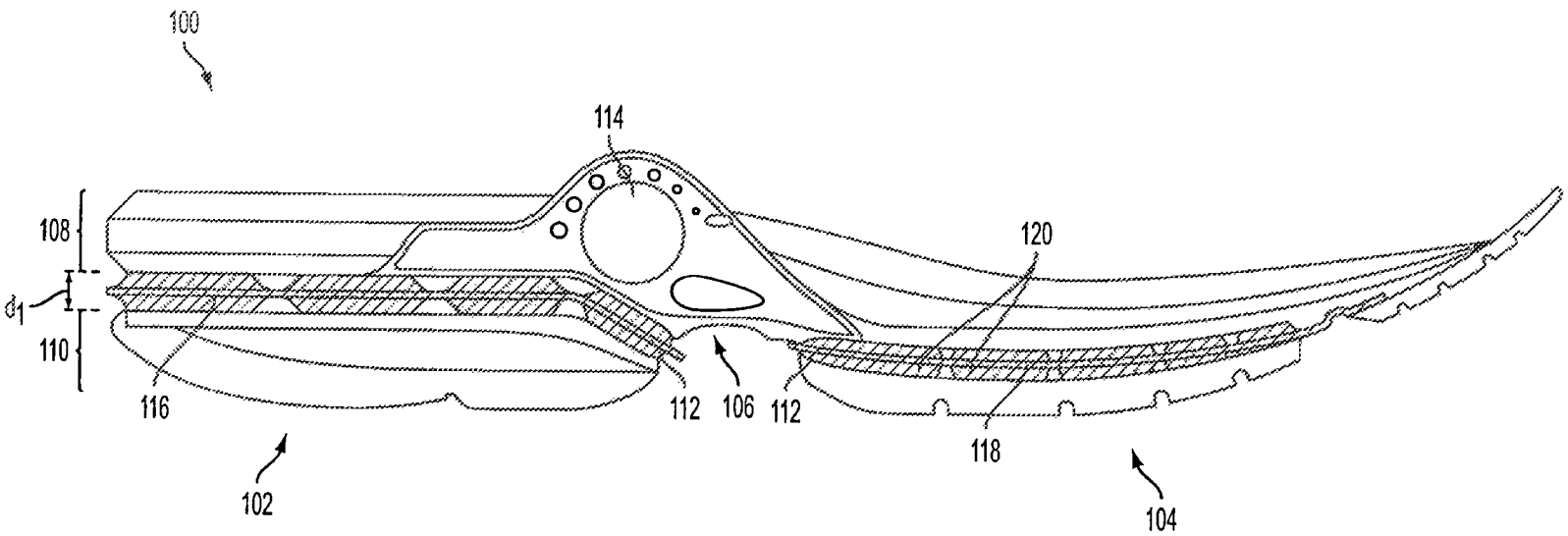
FIG. 1 is a side view of an exemplary sole in an inflated state.

The present invention is now described with reference to the Figures, in which like reference numerals are used to indicate identical or functionally similar elements. Also in the Figures, the left most digit of each reference numeral corresponds to the Figure in which the reference numeral first appears. While specific configurations and arrangements can be used without departing from the spirit and scope of the invention, it will be apparent to a person skilled in the relevant art that this invention can also be employed in other applications.

Figure 2A:
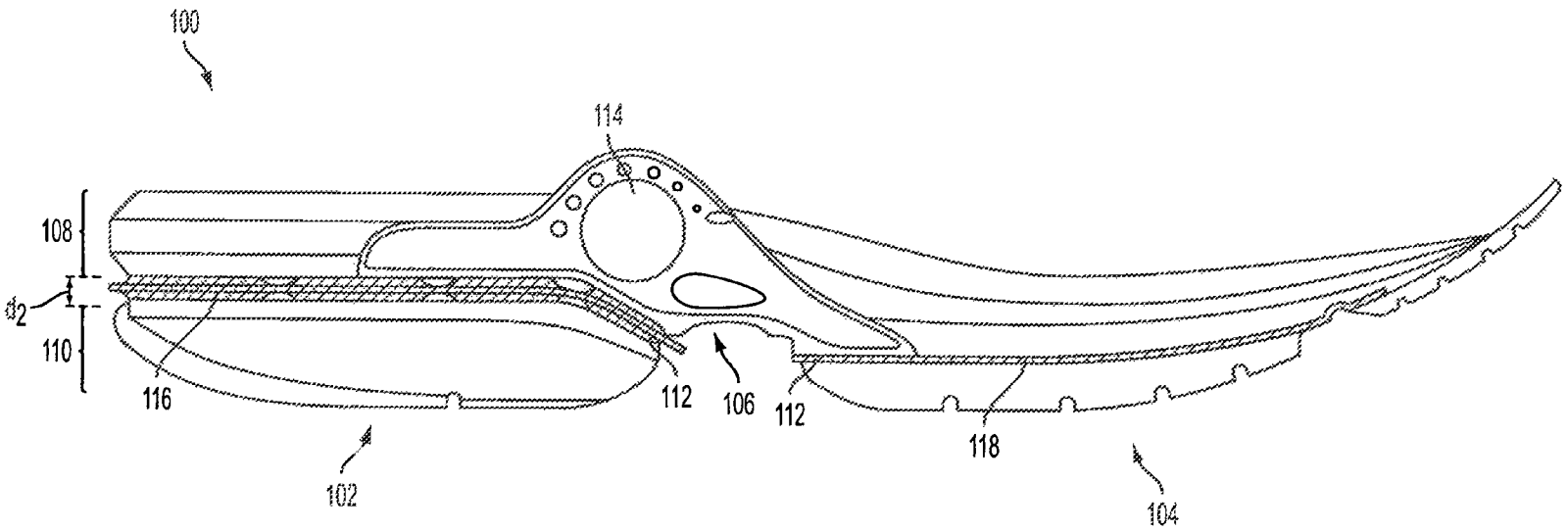
FIG. 2A is a side view of an exemplary sole in a deflated state wherein the bladders are visible.
Figure 2B:
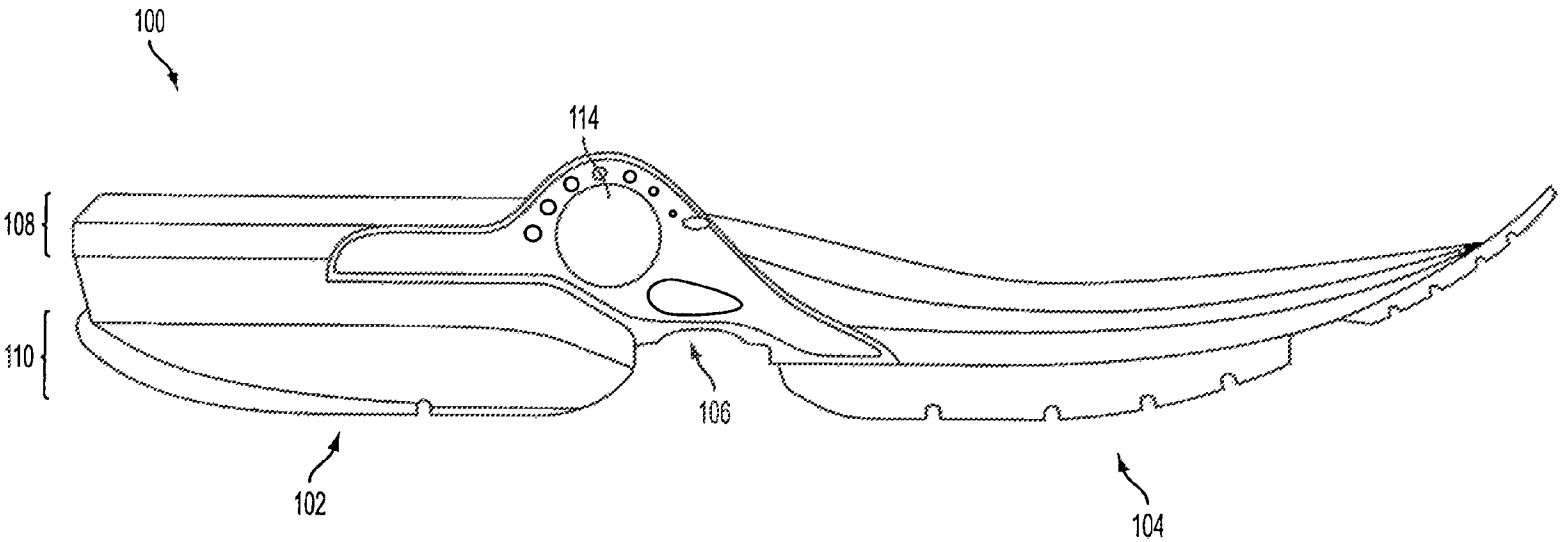
FIG. 2B is a side view of an exemplary sole in a deflated state wherein the bladders are not visible.

A sole of a shoe is shown generally at 100 in FIG. 1. Sole 100 is intended to be incorporated into any shoe including, without limitation, an athletic shoe, a brown shoe, sandal or a dress shoe by attaching it to an upper. As shown in FIG. 1, sole 100 has a heel area shown generally at 102, a forefoot area shown generally at 104 and an arch area shown generally at 106. Sole 100 has an upper sole member 108 and a lower sole member 110 with an inflatable bladder 112 located in between upper sole member 108 and lower sole member 110. Inflatable bladder 112 may be converted or adjusted between a deflated, or less inflated, state as shown in FIGS. 2A and 2B and an inflated state as shown in FIG. 1. Inflating or deflating inflatable bladder 112 changes a thickness of sole 100 (or shoe) such that a distance $d_1$ between upper sole member 108 and lower sole member 110 is greater in the inflated state than a distance $d_2$ between upper sole member 108 and lower sole member 110 in the deflated state, or less inflated state. In either the inflated state or the deflated (less inflated) state inflatable bladder 112 may be fully visible, partially visible or not visible in the assembly. As shown in FIG. 2A, the inflatable bladder may be visible. Alternatively, as shown in FIG. 2B, the inflatable bladder may not be visible in the deflated state because the inflatable bladder is stored in recesses in upper sole member 108 and/or lower sole member 110 and distance $d_2$ (not shown) is about zero.

The inflating and deflating action allows for an adjustable ride to the shoe. For example, the shoe can simulate a racing flat in a less inflated state (e.g., a deflated state) and a more cushioned training shoe in an inflated state. Alternatively, the shoe can have a more cushioned, inflated state for running and a lower profile, less inflated state that can be more stable for training (e.g., weight training). The magnitude of the distance between upper sole member 108 and lower sole member 110 (e.g., $d_1$ or $d_2$) may be different at different points along the sole. For example, the magnitude of the distance between upper sole member 108 and lower sole member 110 (e.g., $d_1$ or $d_2$) may be different at various points along the sole in a generally heel-to-toe direction or in a generally medial-to-lateral direction. The magnitude of the change in distance between upper sole member 108 and lower sole member 110 in the inflated versus deflated state (e.g., $d_1$-$d_2$) may also vary along or across the sole. Sole 100 also has an air pressure regulator 114 that regulates the air pressure in inflatable bladder 112. Air pressure regulator 114 adjusts the pressure threshold at which air is released from inflatable bladder 112 through a pressure release valve. Air pressure regulator 114 may be adjusted so the system is fully open (little or no air accumulates in inflatable bladder 112), regulated (pressure in inflatable bladder 112 varies depending on the setting, as air is allowed to purge through the pressure release valve above the set pressure threshold), or fully closed (inflatable bladder 112 inflates to a maximum inflation pressure and no air is allowed to pass through the pressure release valve).

The sole of the present invention has at least one inflatable bladder and can include a plurality of inflatable bladders such as a first inflatable bladder 116 for a heel area 102 and a second inflatable bladder 118 for a forefoot area 104. Alternatively, there may be a single inflatable bladder that spans substantially the entire sole. Other alternative embodiments with varying numbers and placements of inflatable bladders are also envisioned as would be readily apparent to a person of ordinary skill in the relevant art. Inflatable bladders may be fully visible, partially visible or not visible in the assembly in either the inflated state or the deflated state.

One skilled in the relevant art would readily appreciate that the type of inflatable bladder for use in the shoe of the present invention is not limited. One example of an inflatable bladder includes two films of monolayer or multilayer sealable thermoplastic material through which air may not readily pass. Furthermore, the two sealable thermoplastic films may be a multilayer laminate of film and fabric or of film and a non-woven material. The two films utilized to form the inflatable bladder may be the same material or different materials such as a monolayer film and a multilayer laminate. The films of different materials may be cast or coextruded to form the inflatable bladder. An exemplary film includes an outer layer of 12 mil polyester urethane of 50 D Shore hardness, a scrim layer, and an inner layer of 8 mil polyester urethane of 95A Shore hardness. The scrim layer is present to increase puncture resistance and to increase the tensile strength and its material may include, but is not limited to, 210 denier nylon of high tenacity or polyester. The outer layer material should be of suitable thickness and hardness to increase puncture resistance of the bladder. The inner layers face each other in an assembled inflatable bladder.

The films are sealed around a periphery to form the inflatable bladder. In a preferred embodiment the majority of the peripheral seal is on an inside of the inflatable bladder. Such an inflatable bladder can be made wherein the two films are positioned on top of each other and welded or otherwise sealed along a plurality of the peripheral edges leaving at least one peripheral edge unsealed. The two films are then turned inside out such that the seal is in the interior of the inflatable bladder. Then the remaining peripheral edge(s) is welded or otherwise sealed together to form the inflatable bladder. Alternatively, the peripheral seal is on an outside of the inflatable bladder wherein the two films are positioned on top of each other and welded or otherwise sealed along the peripheral edges. The welding or sealing may include, but is not limited to, RF welding or heat sealing. Inflatable bladders can be shaped to have a plurality of interconnected inflatable chambers 120 as shown in FIG. 1 or a single chamber. A plurality of interconnected inflatable chambers can be formed by thermoforming the films and welding or otherwise sealing the films together at areas other than the periphery.

Another example of an inflatable bladder includes a chamber of natural or synthetic plastic or other material through which air may not readily pass. For example, the inflatable bladder can include a plastic part that includes a chamber or can include two or more plastic parts that are sealed together so as to form a chamber. Suitable plastic parts can include one or more films, injection molded parts, blow molded parts, rotomolded parts, cast parts, plastic dipped parts, composites, laminates, and combinations thereof. Parts can be sealed around a periphery to form the inflatable bladder. Sealing can include welding, adhesion, and other types of sealing including, for example, RF welding or heat sealing. In one embodiment, the inflatable bladder includes an injection molded top part and a thermoplastic film bottom which have been sealed together to foam the bladder. In other embodiments, the inflatable bladder includes a molded top part and a molded bottom part which have been sealed together to form the bladder. In some embodiments, the inflatable bladder includes rubber such as vulcanized rubber.

Upper sole member 108 and lower sole member 110 may be made from conventional materials as would be apparent to a person of ordinary skill in the relevant art, including, but not limited to, foam. Upper sole member 108 and lower sole member 110 may be formed using conventional means as would be apparent to a person of ordinary skill in the relevant art including, but not limited to, injection molding or compression molding. Upper sole member 108 and lower sole member 110 may each include one or more pieces.

Figure 3A:
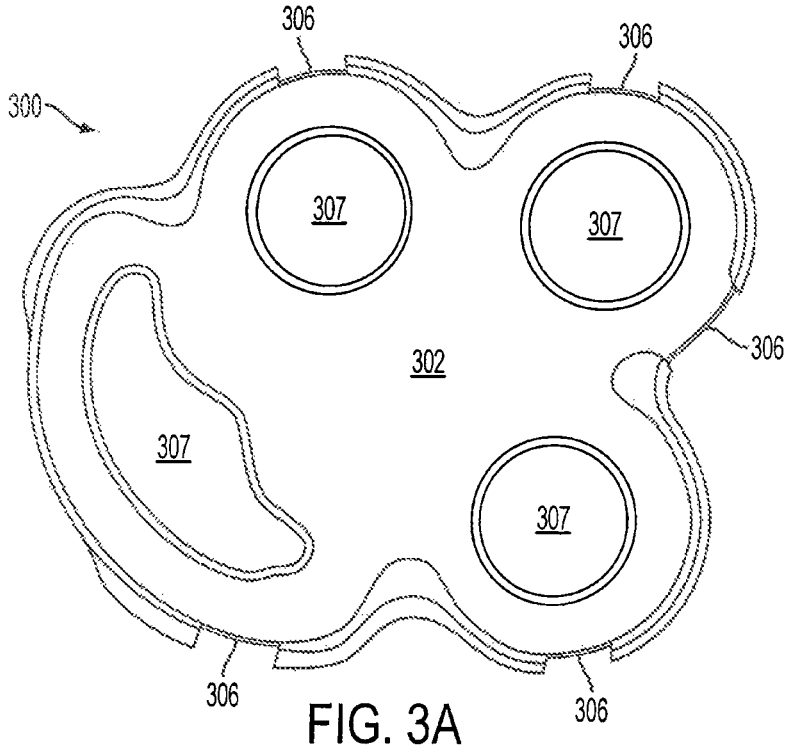
FIG. 3A is a top plan view of an exemplary lower sole member.

A lower surface of upper sole member 108 and an upper surface of lower sole member 110 may have recesses corresponding to a shape of a portion of the inflatable bladder located between the upper sole member 108 and lower sole member 110. The recesses aid in minimizing the thickness of sole 100 in the deflated state, or less inflated state, or aid in locating inflatable bladder 112 between upper sole member 108 and lower sole member 110. FIG. 3A illustrates an exemplary lower sole member 300 having a recessed upper surface 302 and locating features 307 for mounting plates attached to inflatable bladder 112 to lower sole member 300. A lower surface of an upper sole member 108 could have similar recesses and locating features as lower sole member 300 depicted in FIG. 3A.

Figure 3B:
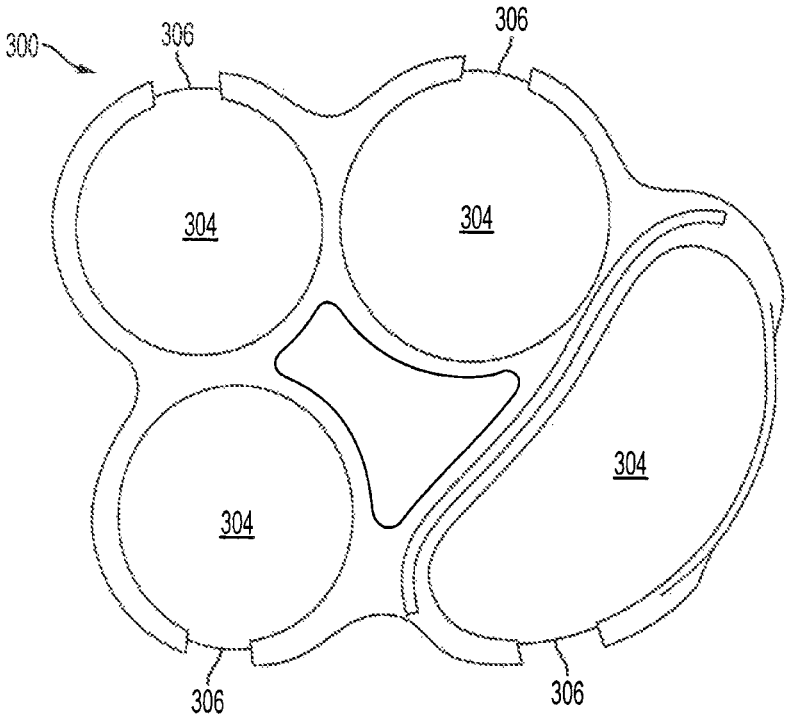
FIG. 3B is a bottom plan view of an exemplary lower sole member.
Figure 4A:
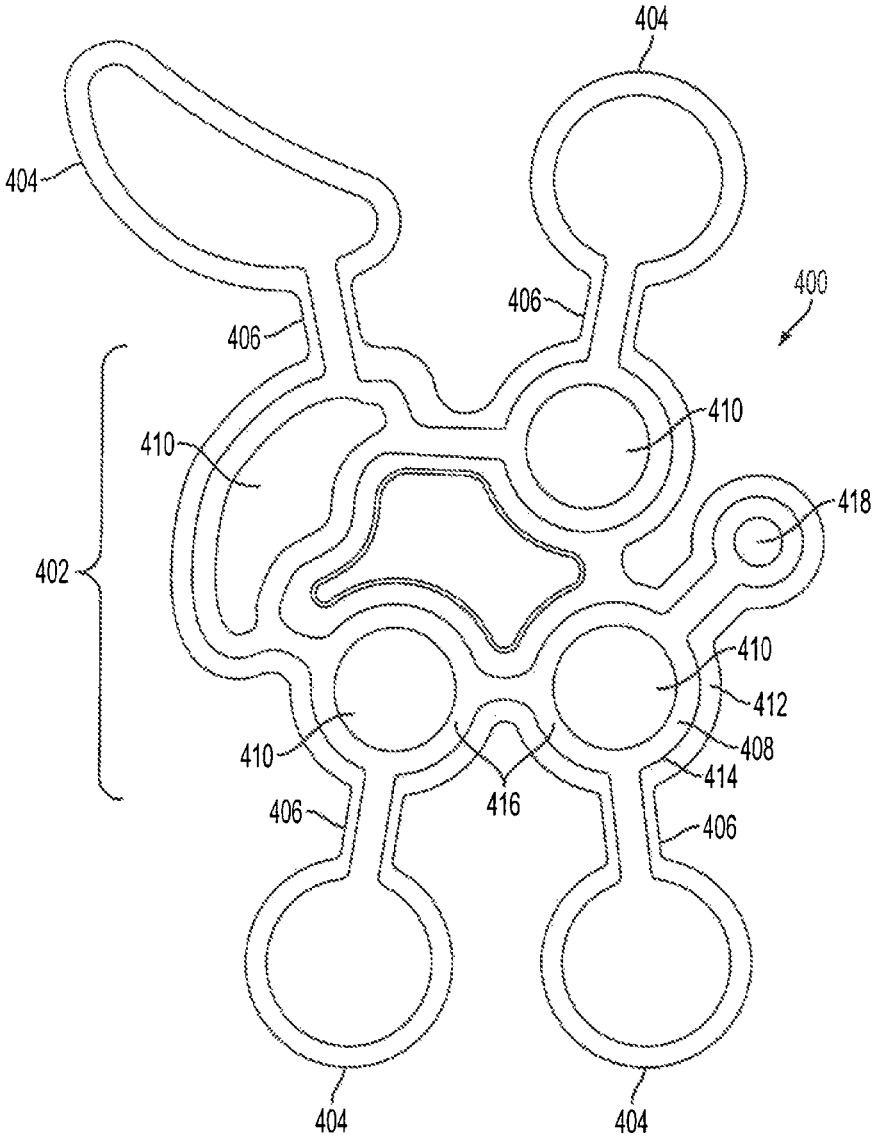
FIG. 4A is an exemplary inflatable heel bladder.
Figure 5A:
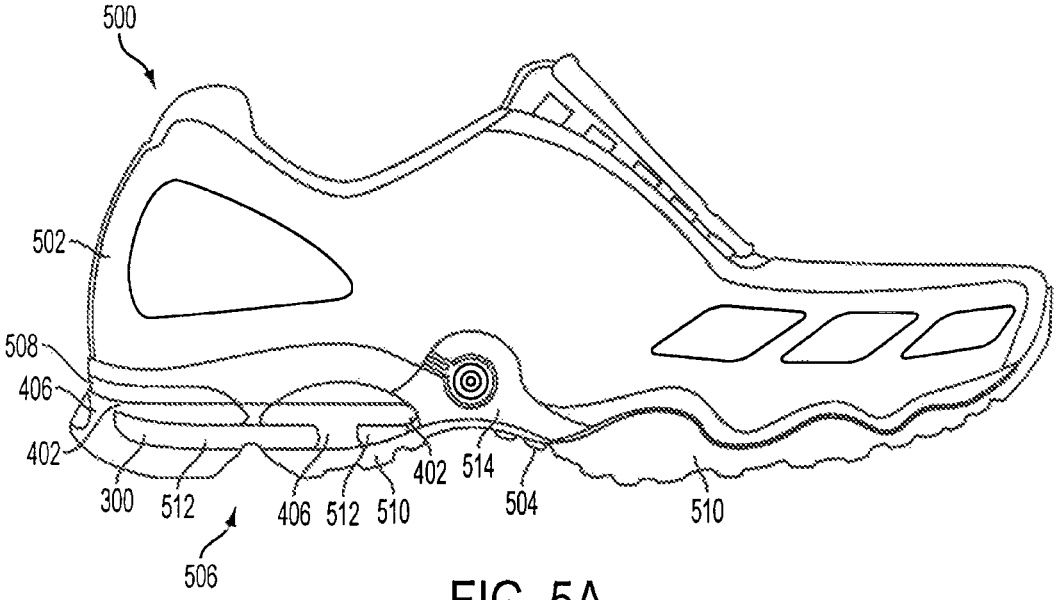
FIG. 5A is a side view of an exemplary shoe having the exemplary lower sole member of FIGS. 3A and 3B and the exemplary inflatable bladders of FIGS. 4A and 4B.
Figure 5B:
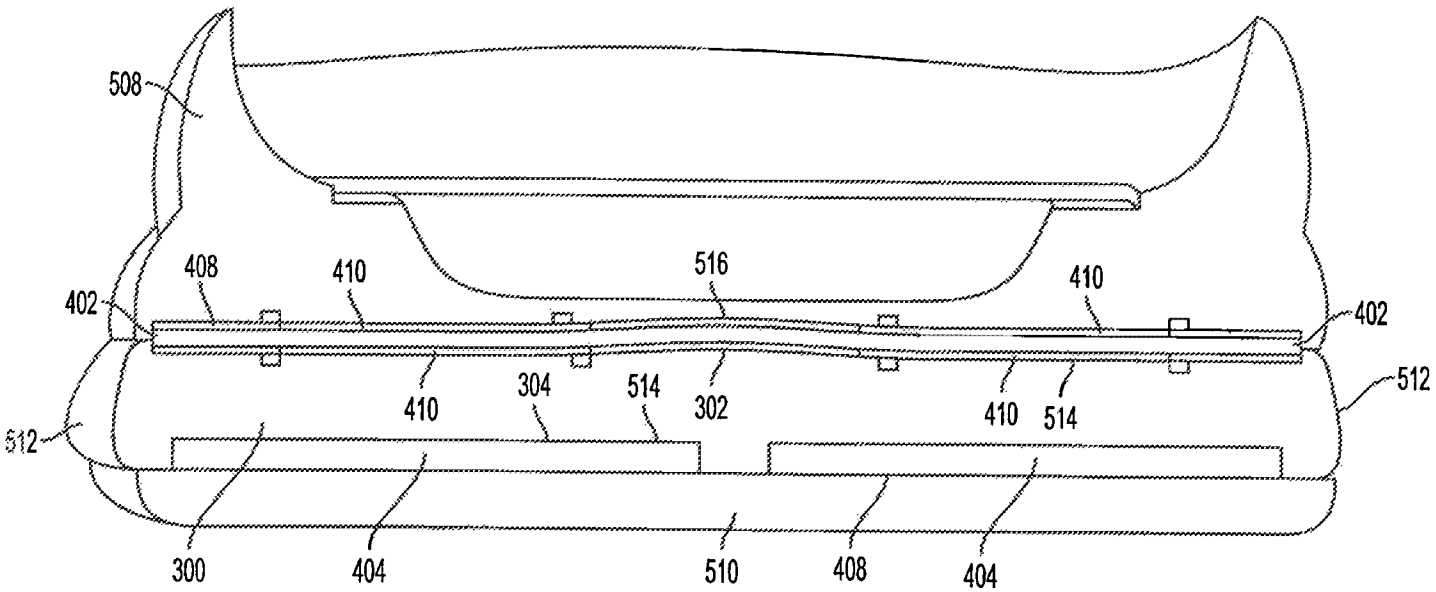
FIG. 5B is a cross-sectional view of a heel section of the exemplary shoe of FIG. 5A.

In one embodiment, at least one portion of the inflatable bladder folds over a side of the lower sole member and the at least one portion attaches to a lower surface of the lower sole member to provide stacked inflatable cushioning elements. FIGS. 3A and 3B depict an exemplary lower sole member 300 for a heel portion of a sole and FIG. 4A depicts an exemplary inflatable heel bladder 400 for a heel portion of a sole. FIGS. 5A and 5B depict an exemplary shoe 500 having an upper 502 and a sole 504. Sole 504 includes exemplary lower sole member 300 and exemplary inflatable bladder 400 assembled at the heel 506. Lower sole member 300 has a recessed upper surface 302, a recessed lower surface 304, and a side surface 512 connecting upper surface 302 and lower surface 304. The side surface has at least one groove 306. A groove 306 is located where a portion of inflatable bladder 400 folds over lower member 300.

Inflatable bladder 400 has a main portion 402 and peripheral portions 404. Main portion 402 has at least one inflatable chamber 416 and is fluidly connected to at least one peripheral portion 404 through extensions 406. Inflatable bladder 400 has a welding flange 412 with an inside edge 414 defining a boundary of inflatable chamber 416. Air may enter inflatable bladder 400 through a barb connector attached at a location 418. Main portion 402 is located between a lower surface 516 of an upper sole member 508 and upper surface 302 of lower sole member 300. Peripheral portions 404 fold over lower sole member 300 such that extensions 406 align with grooves 306. Peripheral portions 404 are attached to lower surface 304 of lower sole member 300.

An outsole 510 may be placed over peripheral portions 404 of inflatable bladder 400 such that peripheral portions 404 are located between lower surface 304 of lower sole member 300 and outsole 510. The outsole material may be a lightweight, flexible, expandable material including, but not limited to, rubber or cast polyurethane, or a textile or suitable flexible substrate, that will expand to a profile of peripheral portions 404 when they are in an inflated state. The outsole material may also have treads or lugs formed thereon through direct injection, casting, cementing, or other known methods. Treads or lugs may also be directly attached to, or integrally part of, an inflatable bladder. For example, in some embodiments, treads or lugs can be formed on a lower portion of an inflatable bladder. Outsole 510 may also wrap up to side surface 512 of lower sole member 300 or extend beyond a gap between lower sole member 300 or upper sole member 508 and bond directly to upper sole member 508. Outsole 510 may also extend toward the leading edge or front edge of lower sole member 500 and connect to the shank 514.

Main portion 402 of inflatable bladder 400 has a first surface 408 that faces upper sole member 508 and a second surface 514 that faces lower sole member 300. First and second surfaces 408, 514 of main portion 402 of inflatable bladder 400 may be directly attached to lower surface 516 of upper sole member 508 or upper surface 302 of lower sole member 300, respectively. For example, in some embodiments, inflatable bladder 400 can include a molded first surface that faces upper sole member 508 or inflatable bladder can include a molded second surface that faces lower sole member 300. Alternatively, either first or second surface 408, 544 of main portion 402 may have one or more plates 410 attached thereto that are then attached to lower surface 516 of upper sole member 508 or upper surface 302 of lower sole member 300, respectively. In some embodiments, the first surface 408 of inflatable bladder 400 or the second surface 514 of inflatable bladder 400 includes an integral plate 410. Plates 410 can include a polymeric material, such as thermoplastic polyurethane. Plates 410 provide a mounting surface between inflatable bladder 400 and lower surface 516 of upper sole member 508 or upper surface 302 of lower sole member 300. Plates may also be located on first and second surfaces 408, 514 of peripheral portions 404 and bonded to lower surface 514 of lower sole member 300 and/or an inside surface of outsole material 510. It is noted that plates may also be located on first and second surfaces of the inflatable bladders depicted in FIGS. 1-2 as well and is not limited to the embodiment of inflatable bladder 400 with a main portion 402 and peripheral portions 404.

Plates 410 are strategically shaped, positioned, and made of suitable materials to control the profile of inflatable bladder 400 in its inflated state, to control the height of inflation, and locate inflatable bladder 400 between upper and lower sole members 508, 300. The greater the offset between an edge of plate 410 and an edge of inflatable bladder 400 (e.g., edge 414), the greater the thickness of inflation. The offset can also be varied to result in a tapered thickness or offset of inflation, either an increase in thickness or offset along a length of an inflatable bladder or a decrease in thickness along a length of an inflatable bladder. For example, the offset can be varied to result in less inflated thickness at a toe of a shoe and more inflated thickness as the forefoot region curves away from the toe.

When plates 410 are present on a surface of inflatable bladder 400, portions of the surface of inflatable bladder 400 not covered by plates 410 are preferably not attached to the upper sole member, the lower sole member, or anything else. This allows the unattached portions of the inflatable bladder to move away from the upper and lower sole members. However, there may be cases where it is preferred that an inflatable bladder be bonded to upper sole member 508, for example in the toe area or to an air transfer manifold 626.

Plates 410 are made from a polymeric material including, but not limited to, thermoplastic polyurethane. Plates 410 may be applied to inflatable bladder 400 through a variety of methods including, but not limited to, casting, silkscreen printing, or laminating through RF welding, direct injection or cold cementing. Another exemplary method for attaching plates 410 to inflatable bladder 400 includes applying a 3 mil film of low melting temperature adhesive film to a substrate of plate material, cutting out the formed assembly to a desired shape, and then affixing the adhesive side to the inflatable bladder through conventional methods including, without limitation, RF welding or heat pressing. Subsequently plates 410 may be cold cemented or otherwise attached to the upper sole member, lower sole member, or other surface. In some embodiments, inflatable bladder 400 can include a surface that includes an integral plate 410. For example, a plate 410 can be formed as part of a surface of inflatable bladder 400 such as by injection molding a plate as a surface of inflatable bladder 400.

Figure 4B:
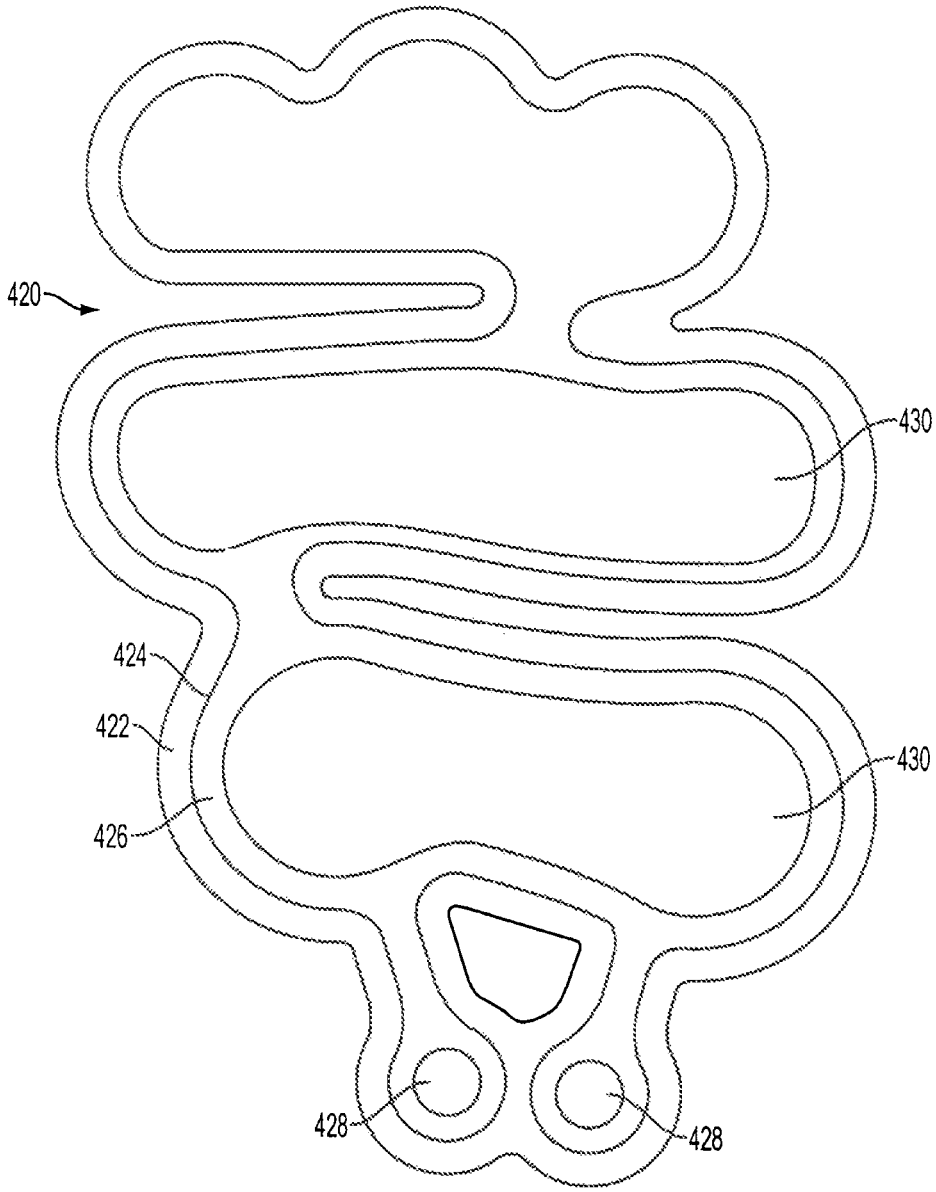
FIG. 4B is an exemplary inflatable forefoot bladder.

FIG. 4B shows an exemplary inflatable forefoot bladder 420. Inflatable bladder 420 has a welding flange 422 with an inside edge 424 defining a boundary of at least one inflatable chamber 426. Air may enter and leave inflatable forefoot bladder 420 through barb connectors attached at locations 428. Inflatable bladder 420 may also have plates 430 thereon. Plates 430 are similar to and serve the same function as plates 410 discussed above.

In some embodiments, as best seen in FIGS. 12-16, an inflatable bladder 1400 may include a plastic part 1200 that is sealed or otherwise attached to a peripheral edge or other portion of a second plastic part 1300. Plastic parts 1200 and 1300 can include one or more films, injection molded parts, blow molded parts, rotomolded parts, cast parts, plastic dipped parts, composites, laminates, and combinations thereof. In some embodiments, at least one of plastic parts 1200 and 1300 includes a material such as, for example, thermoplastic polyurethane. Plastic part 1300 may be molded to have a plurality of chambers 1302 connected through channels 1304. The plastic parts 1200 and 1300 can be sealed around a periphery to form inflatable bladder 1400. Sealing can include welding, adhesion, and other types of sealing including, for example, RF welding or heat sealing. In one embodiment, the inflatable bladder includes an injection molded top part (e.g., plastic part 1200) and a thermoplastic film bottom (e.g., plastic part 1300) which have been sealed together to form the bladder. In other embodiments, the inflatable bladder 1400 includes a molded top part and a molded bottom part which have been sealed together to form the bladder. Inflatable bladder 1400 is inserted between an upper member 1502 and a lower member 1504 of sole 1500. As air enters inflatable bladder 1400, for example through a barb connector attached to plastic part (e.g., plastic film) 1200 at a location 1204, inflatable bladder 1400 expands and increases the thickness of sole 1500.

Inflatable bladder 1400 is inserted between an upper member 1502 and a lower member 1504 of sole 1500 such that plastic part 1300 sits in a cavity formed in upper surface 1608 of lower sole member 1504. Plastic part 1300 may be cemented or otherwise at ached to the cavity in upper surface 1608 of lower sole member 1504. Alternatively, plastic part 1300 may sit in a cavity formed in lower surface 1610 of upper sole member 1502. Plastic part 1200 has an upper surface 1206 that faces a lower surface 1610 of upper sole member 1502. Upper surface 1206 of plastic part 1200 may have a plurality of plates 1202 thereon for attaching plastic part 1200 to lower surface 1610 of upper sole member 1502. Plates 1202 are similar to and serve the same function as plates 410 discussed above. In some embodiments, plastic part 1200 includes integral plates 1202.

Figure 15:
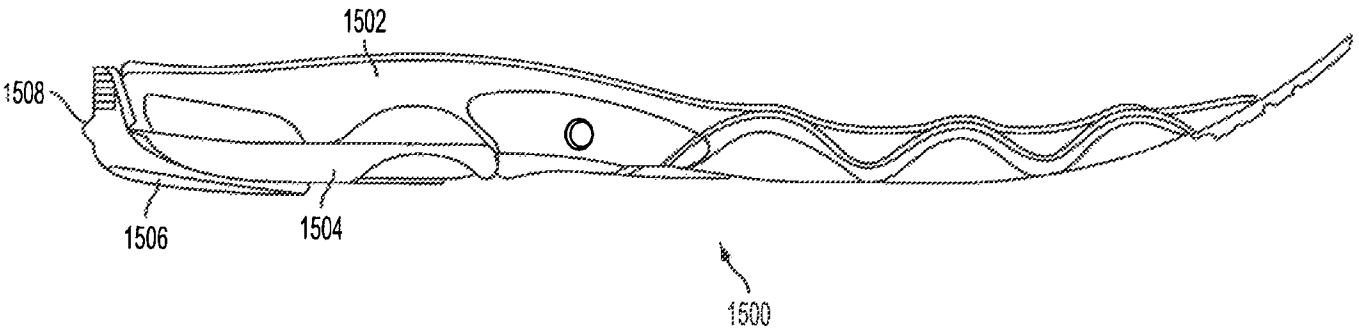
FIG. 15 is a side view of an exemplary sole having the exemplary inflatable bladder of FIG. 14 in the heel region and having an exemplary shear controlling member.
Figure 16:
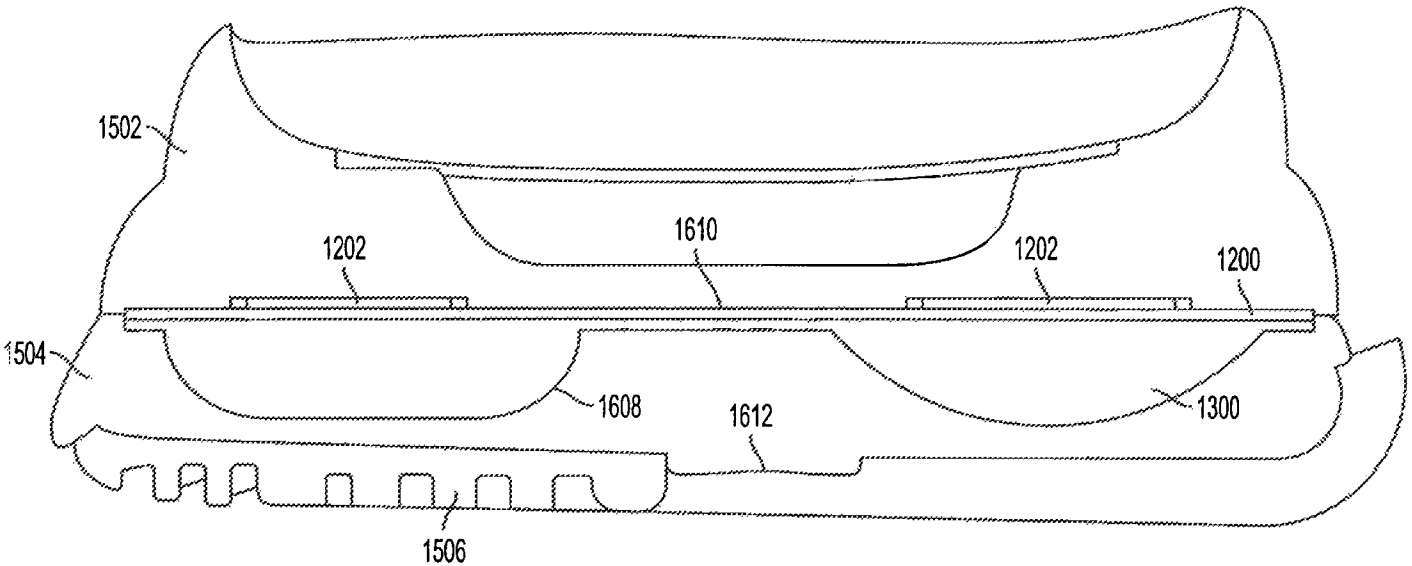
FIG. 16 is a cross-sectional view of a heel section of the exemplary shoe of FIG. 15.

The shoes and soles disclosed herein may have a gap member that bridges a gap between an upper sole member and a lower sole member. The gap member can help to control shear stress between the upper sole member and the lower sole member and thereby act as a shear controlling member. A gap member is shown in FIG. 15, but is merely exemplary and may be included in all embodiments of the shoes and soles disclosed herein. Gap member 1506 is attached to lower sole member 1504, spans the gap between lower sole member 1504 and upper sole member 1502, and attaches to upper sole member 1502. In some embodiments, sole 1500 has a gap member 1506 that is attached to a lower surface 1612 of lower sole member 1504 and wraps around the heel of sole 1500 and attaches to upper sole member 1502. Material for gap member 1506 may include, without limitation, a flexible rubber. Gap member 1506 has a flexible portion 1508 that flexes or stretches as the inflatable bladder is inflated and deflated. Preferably, flexible portion 1508 of gap member 1506 is not fixed to either upper sole member 1502 or lower sole member 1504. Gap member 1506 can provide additional structure to control shear stress and restrict relative movement and/or spacing between upper sole member 1502 and lower sole member 1504.

Figure 6:
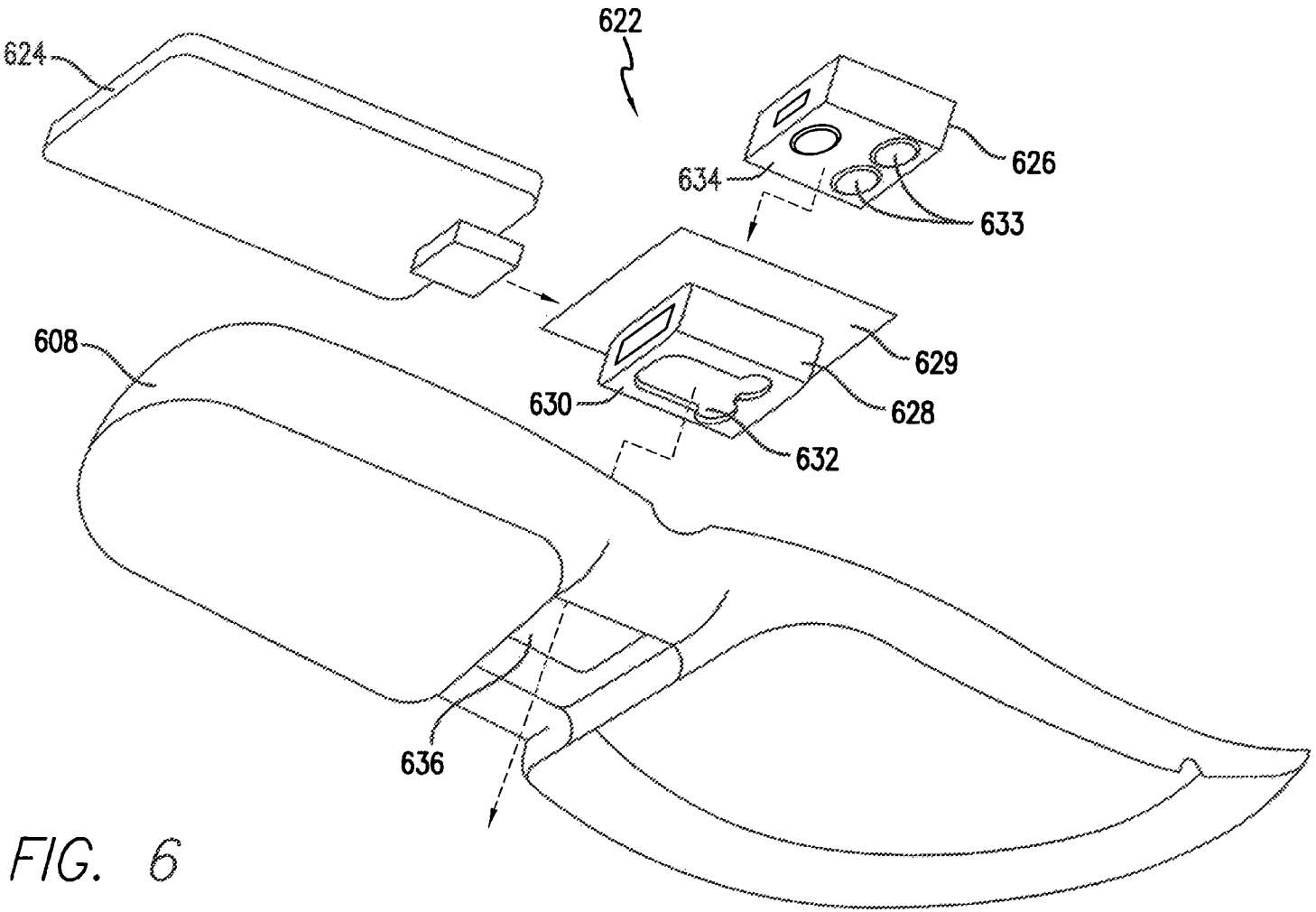
FIG. 6 is an exploded view of an exemplary inflation mechanism and air transfer manifold incorporated into a sole.
Figure 7:
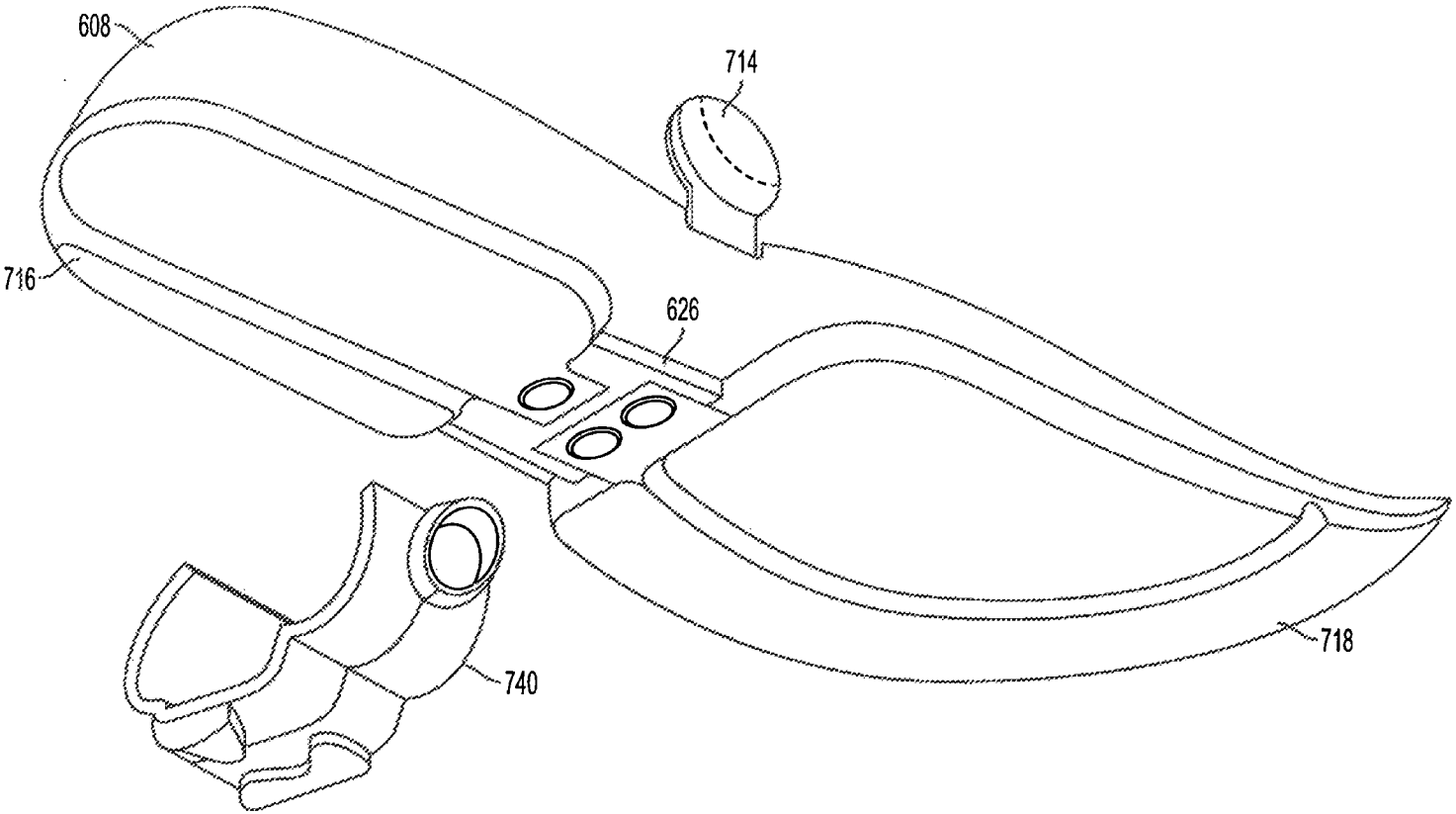
FIG. 7 is an exploded view of a an exemplary air pressure regulator incorporated into a sole.
Figure 8:
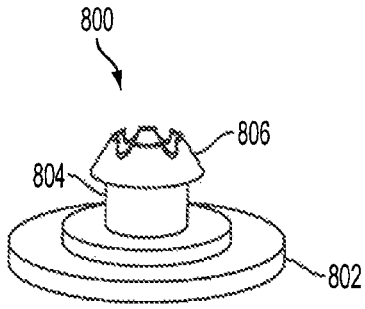
FIG. 8 is a perspective side view of an exemplary barb connector.

In order for a wearer to customize the amount of air in a bladder, the bladder is placed in fluid communication with an inflation mechanism and an air pressure regulator. FIGS. 6-7 illustrate an exemplary arrangement of an inflation mechanism generally shown at 622. Inflation mechanism 622 consists of an underfoot pump 624 fluidly connected to an air transfer manifold 626, which can sit in a manifold seating 628. Preferably underfoot pump 624, manifold seating 628 and manifold 626 are injection molded from a polymeric material including, but not limited to, thermoplastic polyurethane, although other methods of formation may be used, as would be apparent to a person of ordinary skill in the relevant art. Manifold seating 628 has a bottom surface 630 with an opening 632 that allows access to a plurality of openings 633 in bottom surface 634 of manifold 626. Underfoot pump 624 sits in an indentation (not shown) on the upper surface of upper sole member 608. It is noted that while underfoot pump 624 is shown located in a heel region, it may be located anywhere along the top of upper sole member 608 or under upper sole member 608. Upper sole member 608 has an opening 636 for receiving manifold 626 and manifold seating 628 such that a flange 629 of manifold seating 628 prevents manifold 626 and manifold seating 628 from falling through opening 636. Alternatively, manifold 626 may have a peripheral flange that rests against an upper surface of upper sole member 608 to prevent manifold 626 from falling through opening 636, thereby eliminating the need for manifold seating 628. A bottom surface 634 of manifold 626 and manifold seating 628 are flush with opening 636 in upper sole member 608. Openings 633 on bottom surface 634 of manifold 626 are accessible for receiving barb connectors, as shown generally at 800 in FIG. 8, of bladders to fluidly connect the inflatable bladders to underfoot pump 624 via manifold 626. Barb connector 800 has a flange 802, a body 804 extending from flange 802, and at least one conical barb 806 at an end of body 804 opposite flange 802.

As shown in FIG. 7, inflatable bladder 716 and inflatable bladder 718 are fluidly connected to openings 633 in bottom surface 634 of manifold 626 via a barb connector 800 or other means. The bladder arrangement illustrated in FIG. 7 is merely exemplary and alternative arrangements such as a single bladder or any other arrangement that would have been apparent to a person of ordinary skill in the relevant art are also envisioned.

Air enters inflation mechanism 622 through an air intake hole (not shown) in underfoot pump 624 and passes through a one-way valve (not shown) into manifold 626 when underfoot pump 624 is compressed. The one-way valve prevents air from flowing back into underfoot pump 624. Manifold 626 has one or more pathways that direct the air into bladders 716, 718, thereby inflating the bladders. The manifold may include flow restrictors that limit airflow to or from a bladder, and thereby tears in the bladder, bladder bursts, or backflow pressure can be eliminated or reduced.

Figure 9:
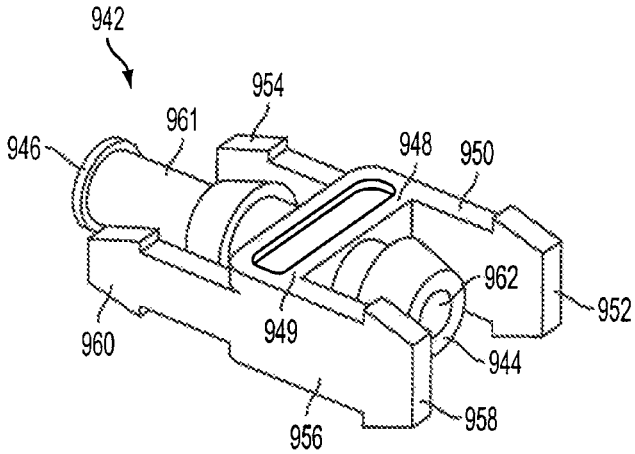
FIG. 9 is a perspective view of an exemplary one-way valve for use in an exemplary inflation mechanism.

An exemplary one-way valve is shown generally at 942 in FIG. 9. One-way valve 942 is preferably a molded piece of a smooth, nonporous material including, but not limited to, polycarbonate that is inserted between underfoot pump 624 and manifold 626. One-way valve 942 is generally cylindrical in shape and has a first end 944 and a second end 946. A first extension 948 and a second extension 949 extend perpendicularly from an axis of the body of one-way valve 942 on opposite sides from each other. A first connector arm 950 with a first end 952 and a second end 954 extends from first extension 948 substantially parallel to the cylindrical body and a second connector arm 956 with a first end 958 and a second end 960 extends from second extension 949 substantially parallel to the cylindrical body. There is at least one outlet air opening (not shown) along a circumference of the cylindrical body adjacent second end 946 of one-way valve 942. An elastomeric sleeve 961 surrounds the outlet opening adjacent second end 946. First end 944 of one-way valve 942, first end 952 of first connector arm 950 and first end 958 of second connector arm 956 are inserted into an air fitment receptacle (not shown) of underfoot pump 624 such that first and second extensions 948, 949 abut the air fitment receptacle. Second end 946 of one-way valve 942, second end 954 of first connector arm 950 and second end 960 of second connector arm 956 are inserted into openings in manifold 626 such that manifold 626 abuts first and second extensions 948, 949.

When underfoot pump 624 is compressed, air flows into an opening 962 in first end 944 of one-way valve 942 and through the valve body to the outlet opening (not shown). The force of the air pushes against elastomeric sleeve 961 covering the outlet opening causing it to expand allowing air to escape out the outlet opening past elastomeric sleeve 961 and into manifold 626. When the pressure is released from underfoot pump 624, elastomeric sleeve 961 returns to its original, unexpanded state such that air cannot flow back into valve 942 or into underfoot pump 624.

Inflation mechanism 622 described above, is merely exemplary and a variety of other inflation mechanisms may be utilized in the present invention. The inflation mechanism may include a manual, automatic, motorized, or electronically-controlled on-board inflation mechanism. In some embodiments, the inflation mechanism is a manually operated inflation device such as one which includes a hand-operated bulb. For example, the inflation mechanism can include a latex bulb which is physically attached to a part of the sole/shoe. Alternatively, the inflation mechanism may include a molded plastic chamber; an external or hand-held pump; or a source of pressurized gas such as pressurized $CO_2$ gas. Alternatively, the inflation mechanism may be a portion of a monolithic bladder that is fluidly isolated from the remainder of the bladder. The isolated portion fluidly communicates with the remainder of the bladder via a one-way valve. The one-way valve allows the isolated portion to act as an inflation mechanism. Alternative inflation mechanisms are described more fully, for example, in U.S. Patent Application Pub. No. 2006/0162186, a copy of which is incorporated herein by reference.

Each inflation mechanism generally includes a one-way valve to be present between the inflation mechanism and the inflatable bladder so that once air enters the inflatable bladder it may not travel backwards into the inflation mechanism. Various types of one-way valves are suitable for use in conjunction with the various alternative inflation mechanisms such as that described in U.S. Pub. No. 2006/0162186, which is incorporated herein by reference.

The inflatable bladder inflated by the inflation mechanism may be fluidly connected to other inflatable bladders located throughout the shoe such that the inflation of one inflatable bladder may in turn inflate other inflatable bladders. Each inflatable bladder may have its own check valve and/or air pressure regulator.

FIG. 7 illustrates an embodiment wherein pressure regulator 714 is fluidly connected to bladders 716, 718 via manifold 626. A protective cover 740 covers and protects bottom surface 634 of manifold 626 and wraps around a medial or lateral side of upper sole member 608 to surround pressure regulator 714. The material for protective cover 740 may include, without limitation, thermoplastic polyurethane or glass-filled nylon. Pressure regulator 714 may comprise an adjustable knob for setting a desired steady state pressure at which the inflatable bladder is to be maintained. The adjustable knob may be adjustable according to ordinary means including, but not limited to, rotating or sliding. For example, adjustment can be made to maintain a steady state pressure of about 0 to about 20 psi. Additional air present in the system bleeds off when the desired steady state pressure is met and pressure regulator 714 will not allow the bladder to be inflated beyond the desired pressure no matter how much a user attempts to inflate the shoe. Pressure regulator 714 may also contain a provision to allow the inflatable bladder to deflate completely or not inflate at all when the desired pressure is set to 0 psi or through actuation of an alternative air pressure regulator. A flip top could be used to access pressure regulator 714 as described in U.S. patent application Ser. No. 11/475,254, filed Jun. 27, 2006, which is incorporated herein by reference. The above described pressure regulator is merely exemplary and other air pressure regulators could be used, such as a release valve, a check valve or a combination check valve and release valve, as described in U.S. Pub. No. 2006/0162186, which is incorporated herein by reference.

Figure 10:
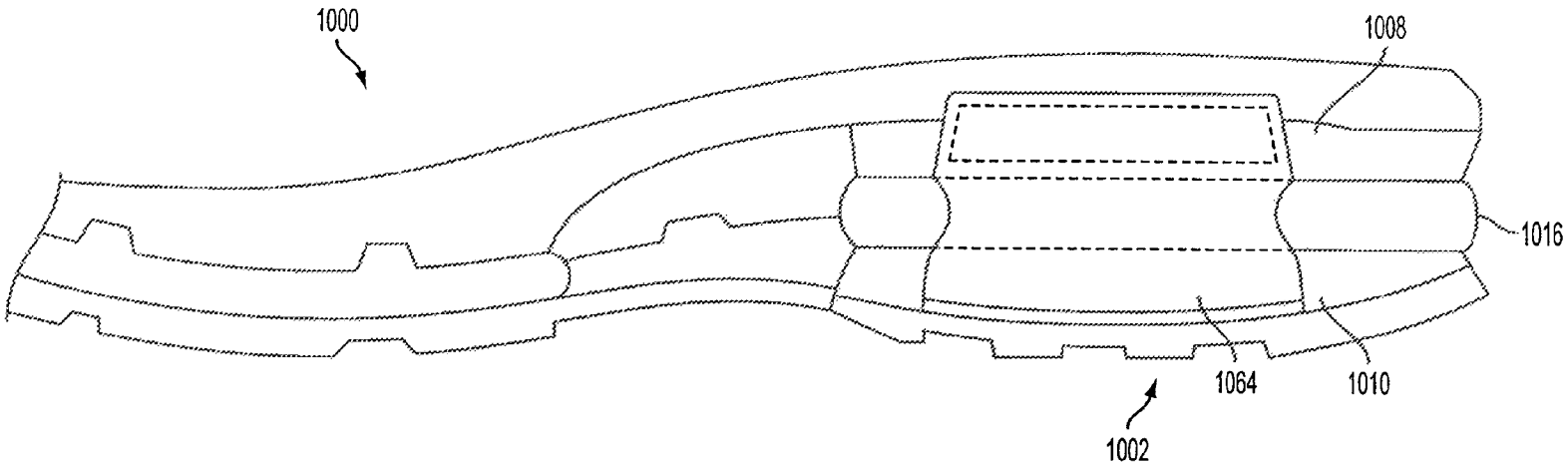
FIG. 10 is a side view of an exemplary sole with an exemplary stiffening member for medial posting.
Figure 11B:
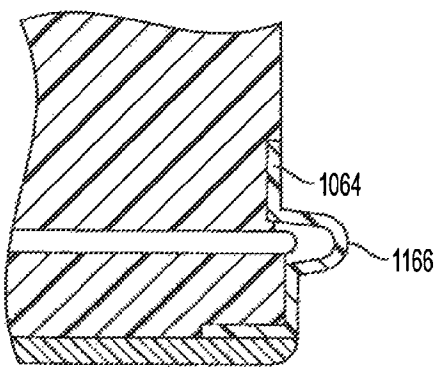
FIG. 11B is a section view of an exemplary sole with an exemplary medial anti-roll device in a deflated state.
Figure 11A:
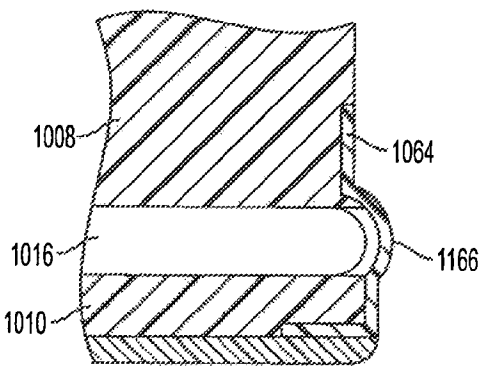
FIG. 11A is a section view of an exemplary sole with an exemplary medial anti-roll device in an inflated state.
Figure 12:
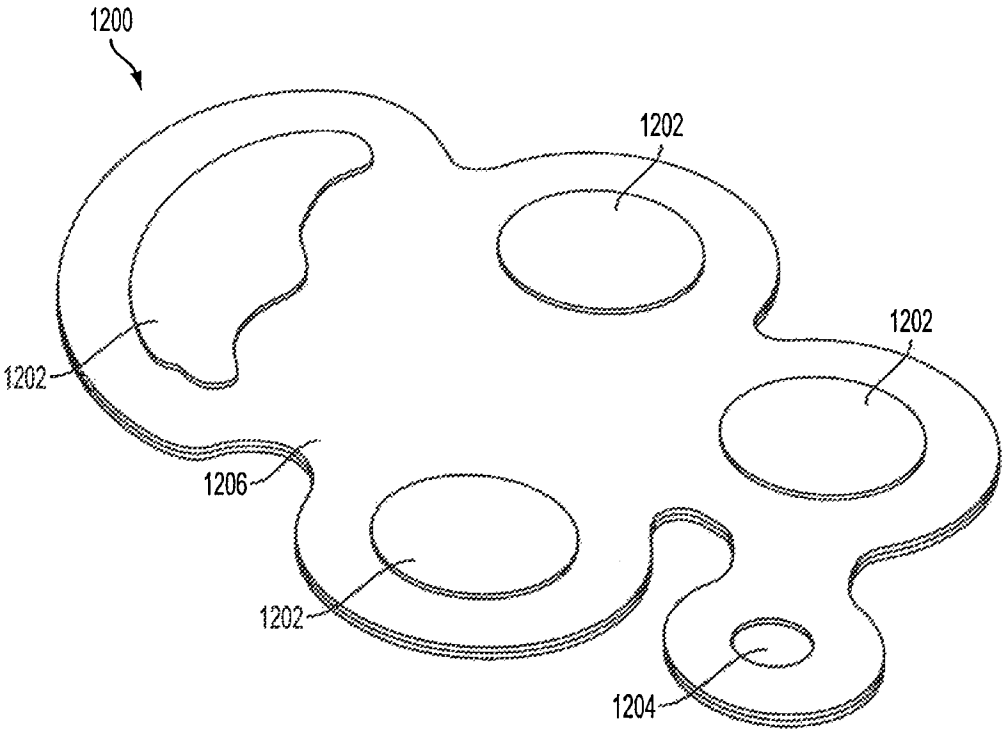
FIG. 12 is a perspective top view of an exemplary plastic part for use in an exemplary inflatable heel bladder.
Figure 13:
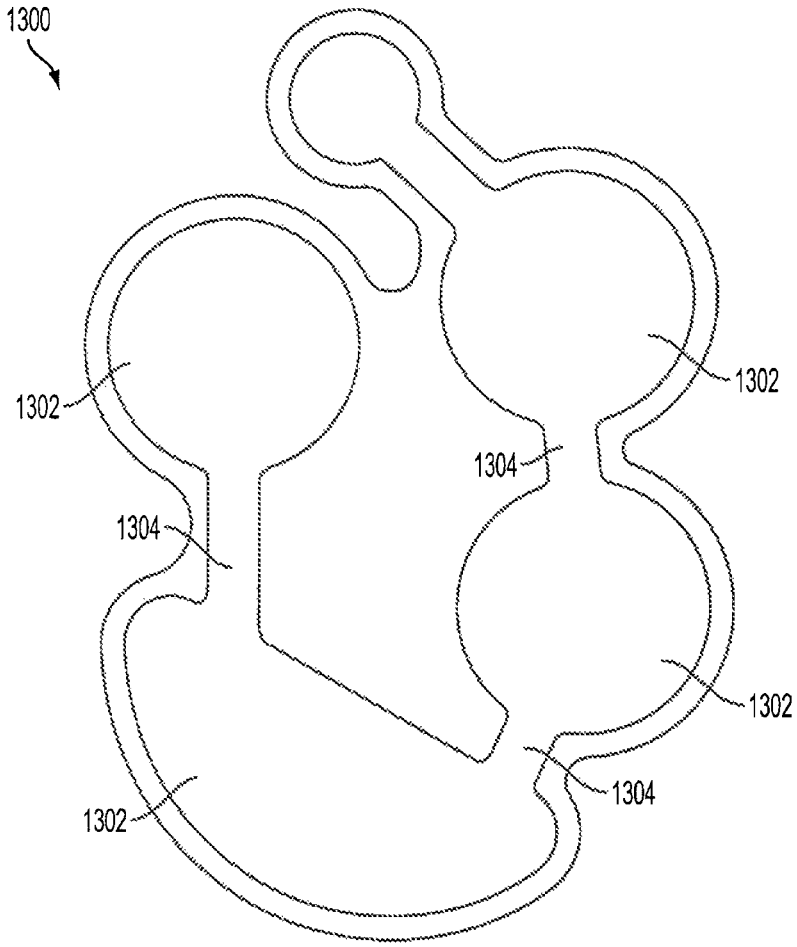
FIG. 13 is a perspective bottom view of an exemplary plastic part for use in an exemplary inflatable heel bladder.
Figure 14:
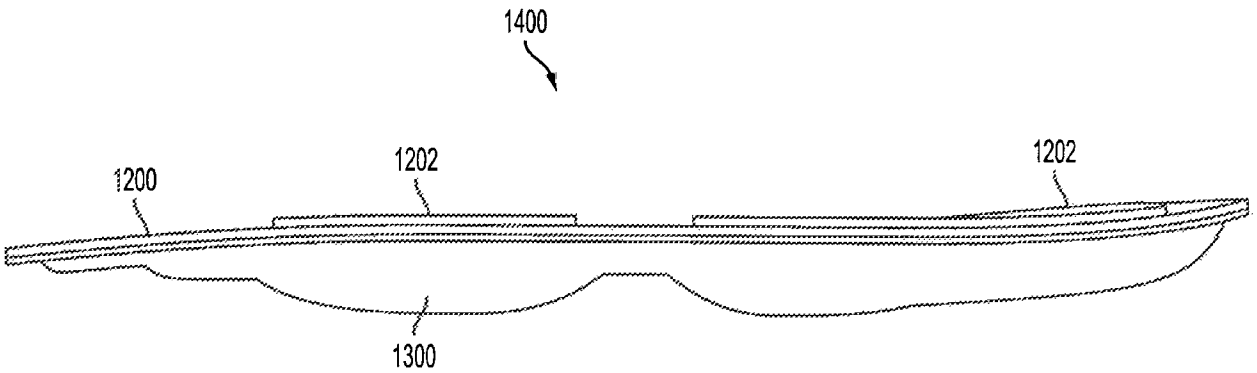
FIG. 14 is a side view of an exemplary inflatable heel bladder formed from the exemplary plastic part of FIG. 12 and the exemplary plastic part of FIG. 13.

In a preferred embodiment, the sole may have a gap member (e.g., a stiffening member for medial posting) attached to the medial side of the sole in a heel area as shown in FIGS. 10, 11A and 11B. Gap member 1064 can be placed in a heel area 1002 of sole 1000 on the medial side in order to prevent the wearer's foot from rolling inwards while moving (pronation). Gap member 1064 is preferably attached to a portion of upper sole member 1008 and a portion of lower sole member 1010 and includes a flexible portion 1166 that flexes or stretches as the inflatable bladder 1016 is inflated and deflated. Gap member 1064 is preferably made of a flexible polymeric material, such as thermoplastic polyurethane, so it can adjust between an inflated state as shown in FIG. 11A and a deflated state as shown in FIG. 11B. The shape of gap member 1064 is merely exemplary and other shapes, as would be apparent to a person of ordinary skill in the relevant art that serve the same function could also be utilized as an alternative. The additional structure provided by gap member 1064 can restrict the relative movement of upper sole member 1008 with respect to lower sole member 1010, so as to prevent excessive pronation. Gap member 1064 may also control relative shear between upper sole member 1008 and lower sole member 1010 and/or limit the overall inflation and/or deflation of inflatable bladder 1016.

Figure 17:
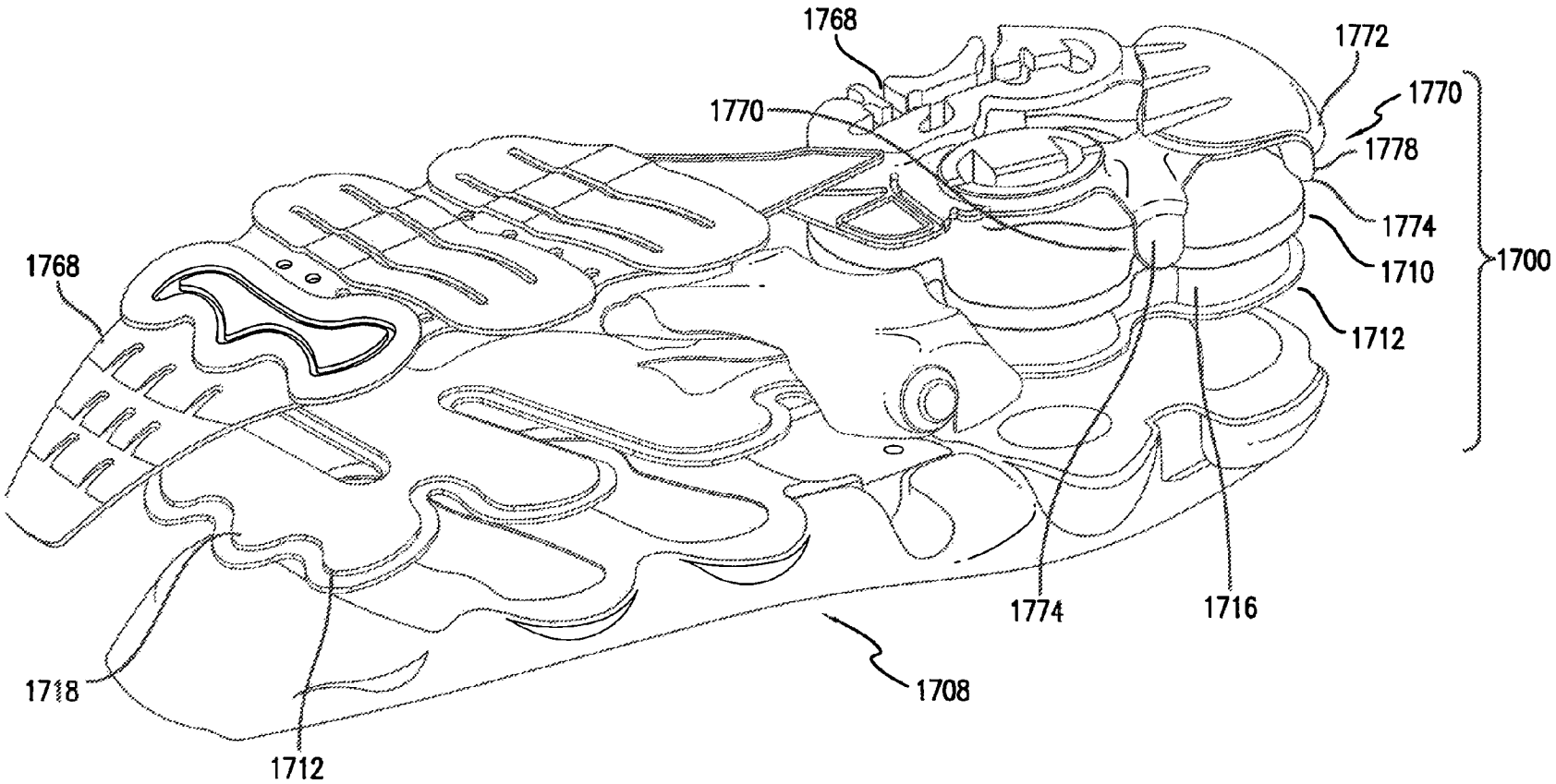
FIG. 17 is an exploded view of an exemplary sole.
Figure 18:
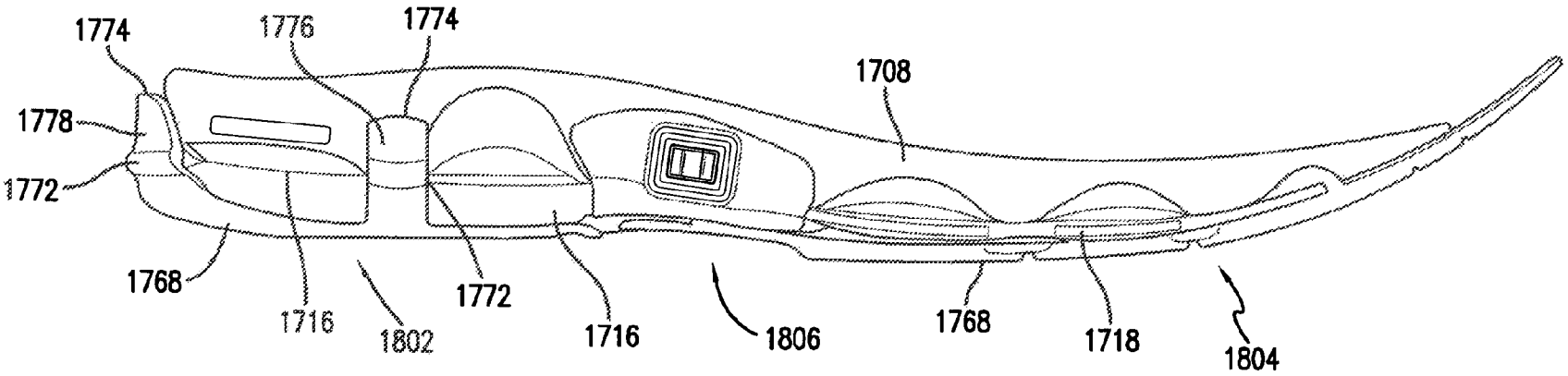
FIG. 18 is a lateral side view of the exemplary sole of FIG. 17.
Figure 19:
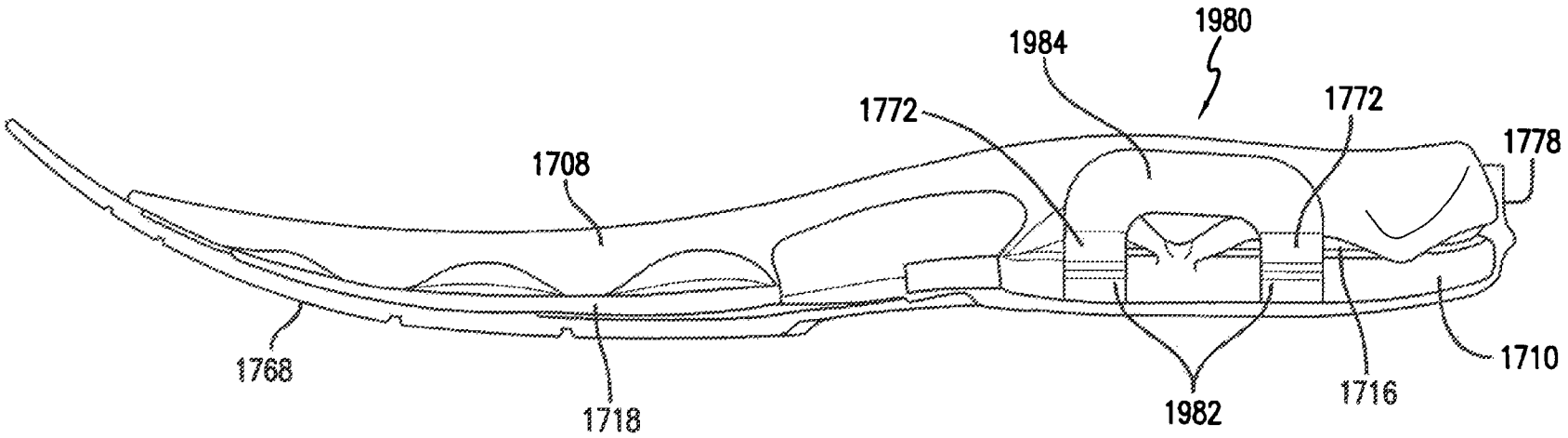
FIG. 19 is a medial side view of the exemplary sole of FIG. 17.

In one embodiment of the present invention, as shown in FIGS. 17-19, wherein like numbers represent like elements, a sole 1700 is similar to sole 100 and may have an outsole 1768 which combines the functions of gap members 1064 and 1506. Sole 1700 is intended to be incorporated into any shoe including, without limitation, an athletic shoe, a brown shoe, a sandal, or a dress shoe by attaching it to an upper. Sole 1700 has a heel area shown generally at 1802, a forefoot area shown generally at 1804 and an arch at shown generally at 1806. Sole 1700 has an upper sole member 1708 and a lower sole member 1710 with an inflatable bladder 1712 located between upper sole member 1708 and lower sole member 1710 or between upper sole member 1708 and outsole 1768. Inflating or deflating inflatable bladder 1712 changes a thickness of sole 1700 in a manner similar to that described above with respect to sole 100.

As noted above with respect to sole 100, sole 1700 has a least one inflatable bladder and may include a plurality of inflatable bladders such as a first inflatable bladder 1716 for heel area 1802 and a second inflatable bladder 1718 for a forefoot area 1804. Alternatively, any of the arrangements, shapes, and materials previously described above for an inflatable bladder may be incorporated into sole 1700. For example, first inflatable bladder 1716 may be similar to inflatable bladder 1400 described above and second inflatable bladder 1718 may be similar to inflatable bladder 420 described above.

Upper sole member 1708 and lower sole member 1710 may each include one or more pieces. Upper sole member 1708 and lower sole member 1710 may be made from conventional materials as would be apparent to a person of ordinary skill in the relevant art, including, but not limited to, foam.

Outsole 1768 may have a ground engaging surface and an opposite surface which contacts lower sole member 1710. While outsole 1768 is only illustrated as contacting a lower sole member 1710 in heel area 1802, it may also contact a lower sole member 1710 in forefoot area 1804. The material for outsole 1768 may include, without limitation, natural or synthetic rubber, thermoplastic polyurethane, foam, or any combination thereof. Sole 1700 may have one or more gap members 1770, wherein each gap member 1770 has a flexible portion 1772 and an end 1774 that connects to upper sole member 1708 such that each gap member 1770 spans a gap in sole 1700. Alternatively, each end 1774 may connect to an upper of a shoe attached to sole 1700. Gap member 1770 may span a gap between outsole 1768 and upper sole member 1708 or between lower sole member 1710 and upper sole member 1708. The one or more gap members 1770 may extend from outsole 1768 or from lower sole member 1710 or may be separate pieces attached to a portion of the sole similar to gap member 1064. Each flexible portion 1772 of each gap member 1770 allows the associated end 1774 to remain connected to upper sole member 1708 (or upper) when a size in the gap is changed as a result of the inflation or deflation of inflatable bladder 1716. Each flexible portion 1772 may buckle from sole 1700 (e.g., buckle outward), flex, or contract as the size of the gap decreases (similar to the buckling of gap member 1064 shown in FIG. 11B) and may straighten, flex, or stretch as the size of the gap increases (similar to the straightening of gap member 1064 shown in FIG. 11A). Alternatively, each flexible portion 1772 may buckle from sole 1700 (e.g., buckle inward) as the size of the gap decreases. While FIGS. 18-19 illustrate ends 1774 connected to upper sole member 1708 this is merely exemplary and alternatively, ends 1774 may be connected to the upper of a shoe.

As shown in FIGS. 17-19, gap members 1770 may extend from a lateral side of outsole 1768 to attach to a lateral side of sole 1700 or a lateral side of an upper attached to sole 1700, such as lateral gap member 1776; from a rear side of outsole 1768 to attach to a heel portion of sole 1700 or a heel portion of an upper attached to sole 1700, such as rear gap member 1778; or from a medial side of outsole 1768 to attach to a medial side of sole 1700 or a medial side of an upper attached to sole 1700, such as medial gap member 1980. Outsole 1768 may have a variety of configurations of gap members 1770 and the arrangement illustrated in FIGS. 17-19 is merely exemplary. For example, outsole 1768 may have only one of gap members 1770, 1776, 1778, or 1980, or any combinations thereof. Gap members 1770 may also have a variety of shapes such as, but not limited to, a single prong, as shown for example by lateral gap member 1776 or rear gap member 1778, or an U-shaped gap member, such as an inverted U-shaped gap member having two prongs 1982, each with its own flexible region, with a connecting member 1984 which connects the ends of prongs 1982 and is connected to sole 1700 or an upper attached to sole 1700, as shown for example by medial gap member 1980. Connecting member 1984 is illustrated as being straight in FIG. 19, but alternatively connecting member 1984 may have a variety of different shapes, including, but not limited to, a curved shape (e.g., an S-shape), an M-shape, or a bellows-shape.

Gap members 1770 can restrict relative movement of upper sole member 1708 and lower sole member 1710, may control relative shear between upper sole member 1708 and lower sole member 1710, and/or may limit the overall inflation and/or deflation of inflatable bladder 1716. Gap members 1770 may be similarly placed as gap member 1064 or gap member 1506. In some embodiments, gap members may be placed in a forefoot portion of a shoe.

Figure 20:
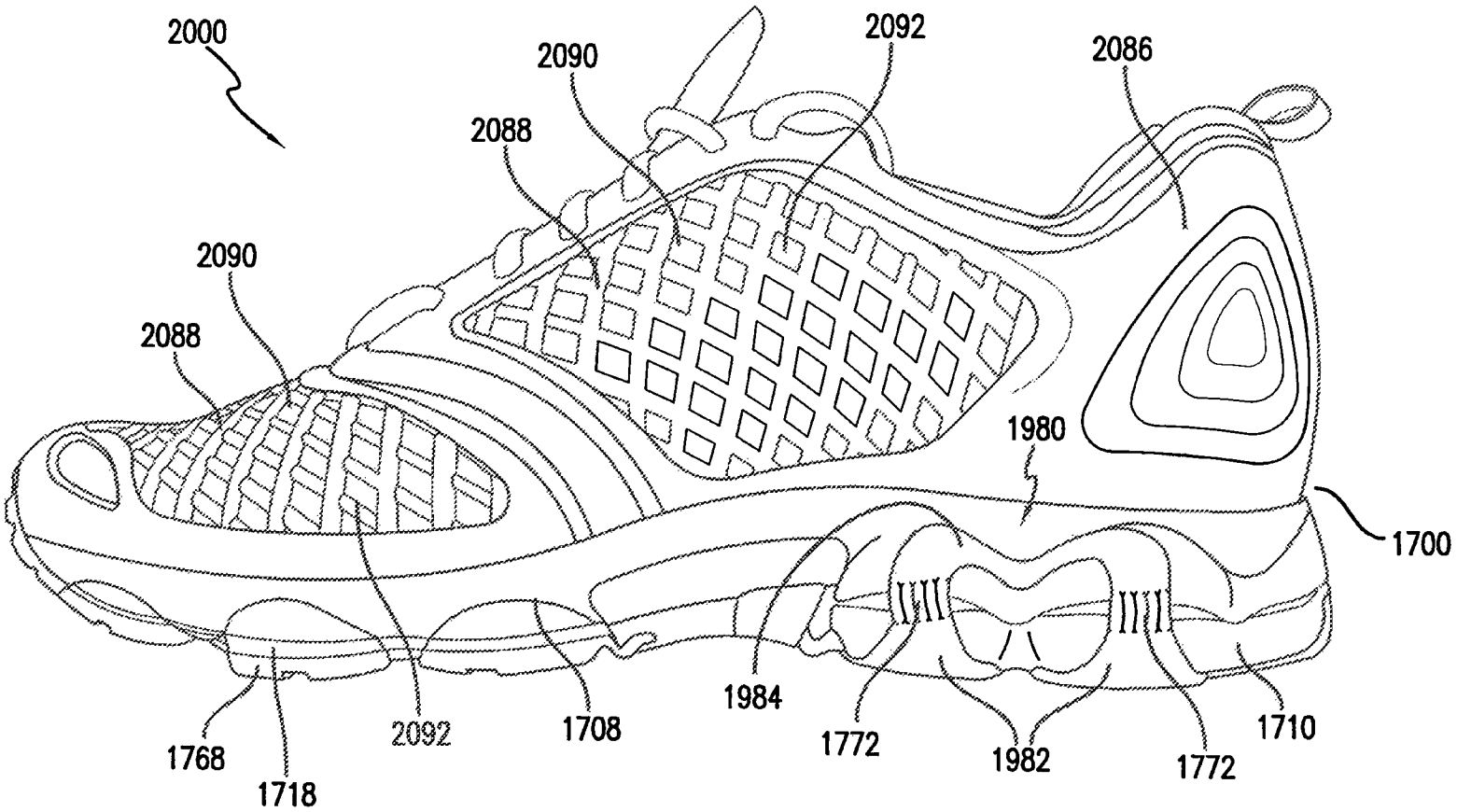
FIG. 20 is a medial side view of an exemplary shoe incorporating the exemplary sole of FIG. 17.

As shown in FIG. 20, an article of footwear 2000 having sole 1700, or any other sole described herein, may have an upper 2086 attached thereto. Portions of upper 2086 can include a cross-hatched matrix 2088 having a plurality of holes 2090. Footwear 2000 can include lining 2092. Lining 2092 disposed within the article of footwear 2000 may be visible through the holes 2090 in upper 2086. Cross-hatched matrix 2088 can include, for example, a molded thermoplastic material such as an injection molded thermoplastic or a composite material. In one embodiment, cross-hatched matrix 2088 includes a laminated composite of synthetic material, EVA, and polyester backing. Lining 2092 may have a plurality of panels with contiguous panels being joined at least partially to one another by at least one close seam in a stitchless manner, such as with a thermoplastic seam tape. Such linings and methods of making them are disclosed in U.S. patent application Ser. No. 11/733,744, filed on Apr. 10, 2007, which is hereby incorporated by reference in its entirety.

A sole or a shoe incorporated with a sole disclosed herein allows the user to adjust the "ride" (cushioning sensation) of the sole/shoe from a state where the inflatable bladder(s) is less inflated (e.g., deflated) to a state in which the inflatable bladder(s) is more inflated to provide more cushioning. Inflating the inflatable bladder can increase the distance between the upper sole member and the lower sole member, thereby increasing the thickness of the sole. Thus, when the inflatable bladder is at least partially inflated, the article of footwear may be in a "run" mode more suitable for running. Conversely, a less inflated bladder can have a smaller distance between the upper sole member and the lower sole member, thereby decreasing the thickness of the sole. Thus, when the inflatable bladder is less inflated, the article of footwear may be in a "train" mode more suitable for training.

The present invention can be carried out on the entire sole, or any portion or combination of portions thereof, such as a forefoot area or a heel area.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. A sole for an article of footwear, comprising:

an upper sole member having a peripheral surface;

a lower sole member having a peripheral surface facing the peripheral surface of the upper sole member;

at least one inflatable bladder disposed between and in contact with the upper sole member and the lower sole member wherein the at least one inflatable bladder has an inflated state and a deflated state and wherein a distance separating facing peripheral surfaces of the upper sole member and the lower sole member is greater in the inflated state than the deflated state; and an air pressure regulator-operatively connected to the at least one inflatable bladder for regulating the air pressure therein, wherein the at least one inflatable bladder comprises a plurality of chambers fluidly connected through at least one channel.

2. The sole of claim 1, wherein the distance separating the upper sole member and the lower sole member at a first point along the length of the sole and a second point along the length of the sole is different.

3. The sole of claim 1, wherein the at least one inflatable bladder is exposed when in the inflated state.

4. The sole of claim 1, wherein the air pressure regulator is disposed on an outer surface of the upper sole member.

5. The sole of claim 1, wherein the air pressure regulator is adapted to be adjusted by the wearer to set a desired air pressure in the at least one inflatable bladder.

6. The sole of claim 1, wherein the air pressure regulator comprises an adjustable knob.

7. The sole of claim 6, wherein the knob is rotatably adjustable.

8. The sole of claim 6, wherein the knob is slidably adjustable.

9. The sole of claim 1, further comprising a protective cover for covering at least a portion of the air pressure regulator.

10. The sole of claim 9, wherein the protective cover extends from the lower sole member to the air pressure regulator.

11. The sole of claim 1, wherein the at least one inflatable bladder further comprises:

a first inflatable bladder positioned in a forefoot area of the sole; and a second inflatable bladder positioned in a heel area of the sole.

12. The sole of claim 1, wherein the at least one inflatable bladder is positioned in a heel area of said sole.

13. The sole of claim 1, wherein the at least one inflatable bladder is positioned in a forefoot area of the sole.

14. The sole of claim 1, wherein the upper sole member includes an upper outer sidewall and the lower sole member includes a lower outer sidewall, and wherein a distance between the upper outer sidewall and the lower outer sidewall is greater in the inflated state than the deflated state.

15. The sole of claim 1, wherein at least a portion of the bladder is monolithic over the plurality of chambers.

16. The sole of claim 1, wherein the upper sole member and the lower sole member each defines a portion of an exterior surface of the sole.

17. The sole of claim 1, wherein the at least one inflatable bladder is not disposed between the facing peripheral surfaces.

* * * * *